US011206957B2

(12) United States Patent
Murphy et al.

(10) Patent No.: US 11,206,957 B2
(45) Date of Patent: Dec. 28, 2021

(54) SHEET PRODUCT LEVEL SENSOR CALIBRATION AND INDICATION SYSTEMS AND METHODS

(71) Applicant: GPCP IP Holdings LLC, Atlanta, GA (US)

(72) Inventors: David Warren Murphy, Neenah, WI (US); Duane Douglas Oram, III, Oshkosh, WI (US); David Arthur Stank, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/941,980

(22) Filed: Jul. 29, 2020

(65) Prior Publication Data

US 2020/0352399 A1 Nov. 12, 2020

Related U.S. Application Data

(62) Division of application No. 15/971,393, filed on May 4, 2018, now Pat. No. 10,874,265.

(Continued)

(51) Int. Cl.
*A47K 10/38* (2006.01)
*A47K 10/36* (2006.01)

(Continued)

(52) U.S. Cl.
CPC ..... *A47K 10/38* (2013.01); *A47K 10/16* (2013.01); *A47K 10/26* (2013.01); *A47K 10/36* (2013.01);

(Continued)

(58) Field of Classification Search
CPC ..... A47K 10/38; A47K 10/36; A47K 10/16; A47K 10/26; A47K 10/3687;

(Continued)

(56) References Cited

U.S. PATENT DOCUMENTS 5,417,233 A 5/1995 Thomas
5,852,946 A 12/1998 Cowger (Continued)

FOREIGN PATENT DOCUMENTS

WO WO2014098672 A1 6/2014
WO WO2015066644 A2 5/2015

(Continued)

OTHER PUBLICATIONS

Everlight; "1.8 mm Round Subminiature Chip Phototransistor" Issue No. DPT-0000225, Rev. 6, Nov. 25, 2016 (8 pages)http://www.everlight.com/file/ProductFile/PT42-21B-TR8.pdf.

(Continued)

*Primary Examiner* — Michael Collins

(57) ABSTRACT

A sheet product (e.g., napkin) dispenser may include an example calibration system and method for a product depletion curve for accurately determining a product level. An example sheet product dispenser includes a housing, a roll holder, a dispensing mechanism, a sensor, and a controller. The sensor is configured to emit a signal toward the product roll and receive a return signal. The controller is configured to receive a calibration product roll and operate the sensor to emit the signal and receive the return signal. The controller determines a brightness value of the return signal and determines a calibration value associated with the determined brightness value. The determined brightness value is within a range of brightness values associated with the calibration value. The controller adjusts a product depletion curve based on at least the determined calibration value and the determined brightness value. Additionally, example product level notification systems are provided herein.

6 Claims, 23 Drawing Sheets

Related U.S. Application Data

(60) Provisional application No. 62/504,184, filed on May 10, 2017.

(51) Int. Cl.
*A47K 10/16* (2006.01)
*A47K 10/26* (2006.01)
*A47K 10/32* (2006.01)

(52) U.S. Cl.
CPC .. *A47K 10/3687* (2013.01); *A47K 2010/3213* (2013.01); *A47K 2010/3226* (2013.01); *A47K 2010/3233* (2013.01); *A47K 2010/389* (2013.01)

(58) Field of Classification Search
CPC .... A47K 2010/3226; A47K 2010/3213; A47K 2010/3233; A47K 2010/389
USPC ..... 700/231–244
See application file for complete search history.

(56) References Cited

U.S. PATENT DOCUMENTS

| | | | |
|---|---|---|---|
| 6,143,257 | A | 11/2000 | Spriggs |
| 6,310,574 | B1 | 10/2001 | Fehrenbach |
| 6,360,181 | B1 | 3/2002 | Oyler |
| 6,411,920 | B1 | 6/2002 | McConnell |
| 6,585,344 | B2 | 7/2003 | Kolodziej |
| 6,598,473 | B2 | 7/2003 | Atkinson |
| 6,640,628 | B2 | 11/2003 | Luetke |
| 7,044,421 | B1 | 5/2006 | Hoyt |
| 7,079,263 | B2 | 7/2006 | Sartain |
| 7,370,824 | B1 | 5/2008 | Chang |
| 7,508,312 | B2 | 3/2009 | Chajec |
| 7,549,814 | B1 | 6/2009 | Arrington |
| 7,640,876 | B2 | 1/2010 | Memory |
| 7,774,096 | B2 | 8/2010 | Goerg |
| 7,783,380 | B2 | 8/2010 | Detamore |
| 7,793,882 | B2 | 9/2010 | Reinsel |
| 7,866,209 | B2 | 1/2011 | Tenney |
| 7,954,668 | B2 | 6/2011 | Mehus |
| 8,044,844 | B2 | 10/2011 | Nyberg |
| 8,160,742 | B2 | 4/2012 | Goerg |
| 8,167,004 | B2 | 5/2012 | Lee |
| 8,179,528 | B2 | 5/2012 | De Vries |
| 8,201,707 | B2 | 6/2012 | Ophardt |
| 8,224,480 | B2 | 7/2012 | Mok |
| 8,273,504 | B2 | 9/2012 | Goia |
| 8,302,473 | B2 | 11/2012 | Ramus |
| 8,338,811 | B2 | 12/2012 | Lang |
| 8,366,035 | B2 | 2/2013 | Kling |
| 8,465,137 | B2 | 6/2013 | Fujikawa |
| 8,516,883 | B2 | 8/2013 | Studer |
| 8,599,007 | B2 | 12/2013 | Larsson |
| 8,690,014 | B2 | 4/2014 | Haueter |
| 8,723,504 | B2 | 5/2014 | Tanisaki |
| 8,789,787 | B2 | 7/2014 | Kling |
| 8,807,475 | B2 | 8/2014 | Rodrian |
| 8,950,254 | B2 | 2/2015 | Bernhardsgruetter |
| 9,019,367 | B2 | 4/2015 | Hoffmann |
| 9,027,788 | B2 | 5/2015 | Ophardt |
| 9,073,028 | B2 | 7/2015 | Hovinen |
| 9,113,760 | B2 | 8/2015 | Pierquet |
| 9,370,283 | B2 | 6/2016 | Fellhoelter |
| 9,524,604 | B2 | 12/2016 | Erb |
| 9,604,811 | B2 | 3/2017 | Case |
| 10,743,723 | B2 * | 8/2020 | Rozek ..... A47K 10/38 |
| 10,874,265 | B2 * | 12/2020 | Murphy ..... A47K 10/36 |
| 2009/0125424 | A1 | 5/2009 | Wegelin |
| 2009/0204256 | A1 | 8/2009 | Wegelin |
| 2011/0088619 | A1 | 4/2011 | Duerrstein |
| 2012/0138625 | A1 | 6/2012 | Case |
| 2012/0312853 | A1 | 12/2012 | Osborne |
| 2013/0240554 | A1 | 9/2013 | Strahlin |
| 2014/0084075 | A1 | 3/2014 | Vandelli |
| 2014/0367401 | A1 | 12/2014 | Stralin |
| 2015/0102048 | A1 | 4/2015 | Case |
| 2015/0157177 | A1 | 6/2015 | Carper |
| 2015/0223646 | A1 | 8/2015 | Wegelin |
| 2015/0228181 | A1 | 8/2015 | Himmelmann |
| 2015/0253173 | A1 | 9/2015 | Cedulf |
| 2015/0274375 | A1 | 10/2015 | Kling |
| 2015/0274467 | A1 | 10/2015 | Hildebrandt |
| 2015/0286912 | A1 | 10/2015 | Qiyu |
| 2015/0327735 | A1 | 11/2015 | Himmelmann |
| 2016/0187484 | A1 | 6/2016 | Bloomfield |
| 2016/0353946 | A1 | 12/2016 | Osborne, Jr. |
| 2016/0364685 | A1 | 12/2016 | Wass |
| 2017/0051481 | A1 | 2/2017 | Mercer |
| 2019/0350414 | A1 | 11/2019 | Starkey |

FOREIGN PATENT DOCUMENTS

| | | | |
|---|---|---|---|
| WO | WO2015086055 | A1 | 6/2015 |
| WO | WO2015163802 | A1 | 10/2015 |
| WO | WO2016041583 | A1 | 3/2016 |
| WO | WO2016122624 | A1 | 8/2016 |
| WO | WO2016137450 | A1 | 9/2016 |
| WO | WO2017105464 | A1 | 6/2017 |

OTHER PUBLICATIONS

Fairchild Semiconductor Corporation, "QEB373 Subminiature Plastic Infrared Emitting Diode", Nov. 2009 (8 pages).https://www.mouser.com/ds/2/l49/QEB373-890034.pdf.

* cited by examiner

SHEET PRODUCT LEVEL SENSOR CALIBRATION AND INDICATION SYSTEMS AND METHODS

CROSS REFERENCE TO RELATED APPLICATIONS

This application is a divisional of U.S. application Ser. No. 15/971,393, filed on May 4, 2018, which claims the benefit of and priority to U.S. Application No. 62/504,184, filed on May 10, 2017, the disclosures of which are hereby incorporated by reference in their entireties.

FIELD OF THE INVENTION

Example embodiments of the present invention generally relate to dispensers and, more particularly to, determining and/or indicating product level remaining within the dispensers.

BACKGROUND

Sheet product dispensers (e.g., napkin dispensers, paper towel dispensers and tissue dispensers), provide on-demand sheet product to a user from a supply of sheet product stored within the dispenser, such as in roll form. The sheet product may be dispensed from the product roll and presented to the user. Depending on the type of dispenser, dispensing may be accomplished automatically (e.g., with a motor) or manually (e.g., using the force a user applies). Perforations or cutting arrangements may be used to separate the sheet product for use (e.g., form a dispensed portion).

It is desirable in dispensers to avoid an empty scenario, such that there is no available sheet product for dispensing. In this regard, some sheet product dispensers include a product level indicator that can be used to inform maintainers (e.g., janitors, users, etc.) that the sheet product dispenser needs replacement of the sheet product.

BRIEF SUMMARY

Depending on the configuration of the sheet product dispenser, various types of product level sensors can be used to determine the remaining product level within the dispenser. For example, mechanical-based product level sensors can interact directly with the sheet product as it is dispensed to determine the amount of product remaining. In other embodiments, product level sensors may indirectly interact with the sheet product, such as through optical or infrared detection. For example, a sheet product dispenser may utilize a light emitting product level sensor that is directed at the sheet product and configured to receive a reflected light signal. Such a sensor may be configured to measure characteristics of the reflected light, such as the amount of light and/or brightness value, to determine a corresponding amount of product remaining on the product roll. In this regard, the brightness value may be related to the distance the signal traveled and the reflection properties of the product roll (which the signal reflected off).

In some embodiments, the brightness value may be checked against a product depletion curve to determine the amount of product remaining associated with the determined brightness value. However, manufacturing tolerances and other factors may lead to inconsistencies in anticipated brightness values and the actual amount of product remaining per each specific dispenser. In this regard, some example embodiments of the present invention seek to provide an easy to use calibration method for calibrating the product depletion curve for each dispenser such that more accurate product remaining estimations can be achieved. For example, some embodiments of the present invention provide one or more pre-made calibration product rolls (e.g., 0% product remaining, 60% product remaining, and/or 100% product remaining) that can be inserted into the dispenser so that the dispenser may automatically calibrate. In such example embodiments, a product depletion curve may be adjusted based on the determined brightness value associated with the inserted one or more pre-made calibration product rolls. A user interface may guide the maintainer through the process.

Some other example embodiments of the present invention seek to provide a less invasive low product level indication system. Further, some example embodiments provide the ability to turn off or on the low product level indication system, which may be useful for customizing the dispenser, for example, based on what type of end users will interact with the dispenser. As an example, a maintainer may wish to disable the low product level indication system when a non-maintainer end user is present to avoid confusion regarding the meaning of the indication being provided (such as to avoid a user thinking that the dispenser is broken).

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
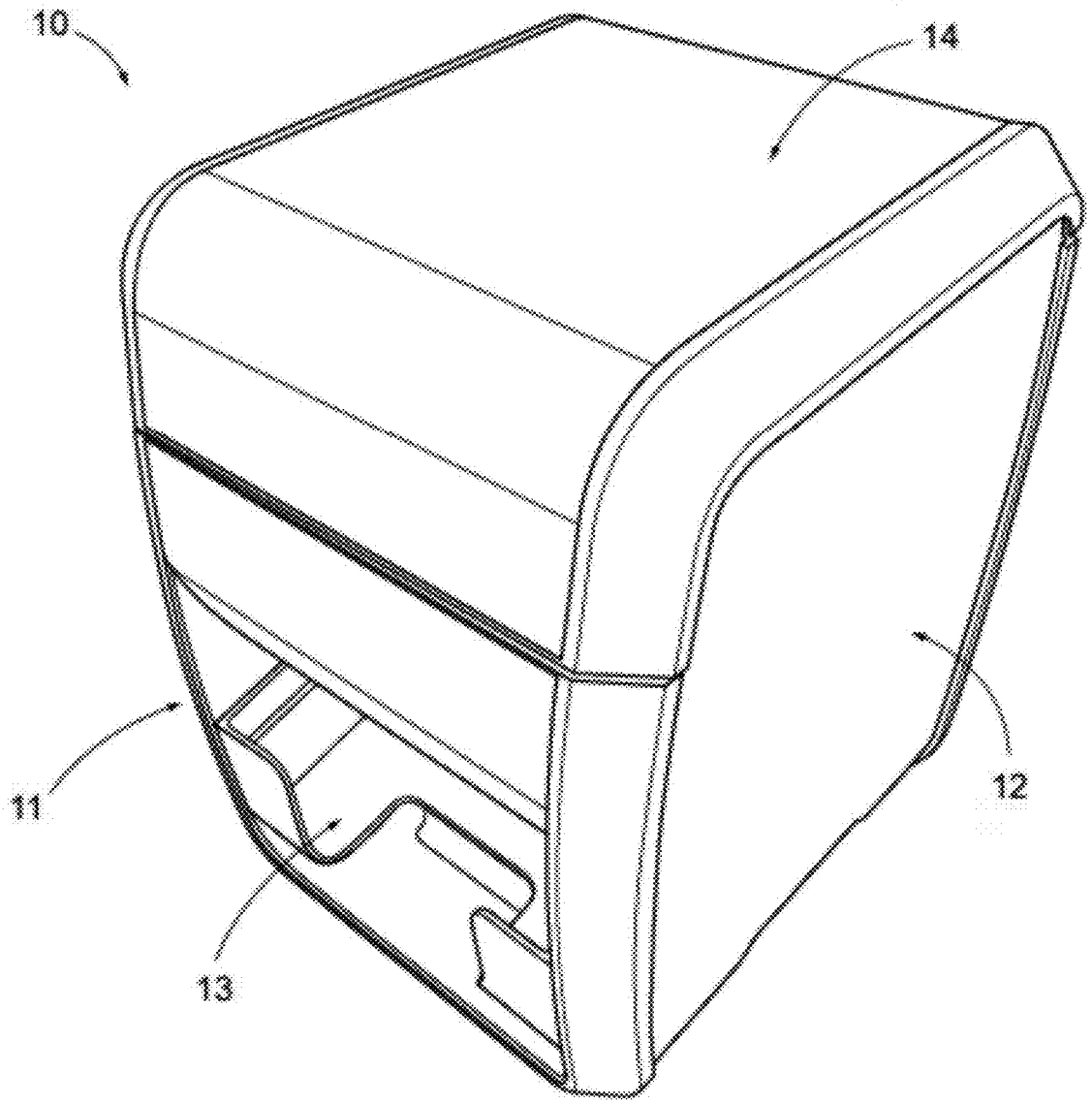
FIG. 1 shows a perspective view of an example sheet product (e.g., napkin) dispenser, in accordance with some embodiments discussed herein.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example product dispensers may be a maintainer (e.g., a maintenance person, a janitor, a facility manager, etc.) or a consumer (e.g., a person receiving a dispensed portion of the product).

Example Sheet Product Dispenser and Product Level Sensor

Figure 12:
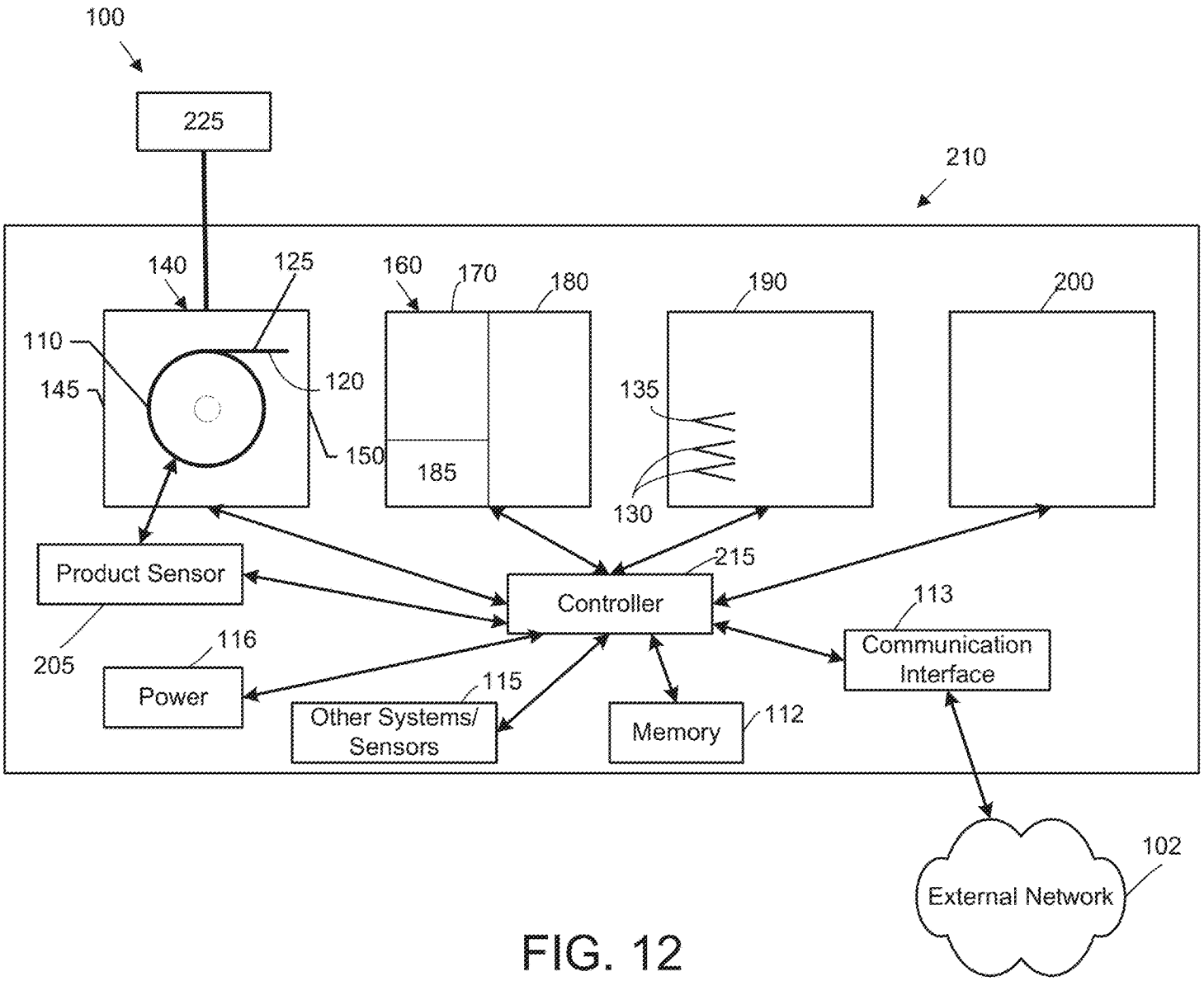
FIG. 12 shows a block diagram illustrating an example napkin dispenser, in accordance with some embodiments discussed herein.

FIG. 1 illustrates an example sheet product dispenser, illustrated as a napkin dispenser 10 according to some embodiments of the present invention (e.g., in accordance with the napkin dispenser 100 and its corresponding components described with respect to FIG. 12). The sheet product dispenser 10 includes a housing (e.g., outer shell) defined by a base portion 12 and a cover 14. The sheet product dispenser 10 includes at least one dispensing area 11 where the sheet product (e.g., napkin) is provided to the user (e.g., in the presentation station 190 described with respect to FIG. 12). Such sheet product may, such as described herein, be dispensed in response to user input being provided to an activation sensor (e.g., in the circumstance where the sheet product dispenser is automated). In some embodiments, a maintainer or user may define how many sheet products are to be received with each dispense (e.g., 1, 2, 3, etc.). For example, upon dispense, the one or more napkins may be presented to the user within tray 13.

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

Figure 2:
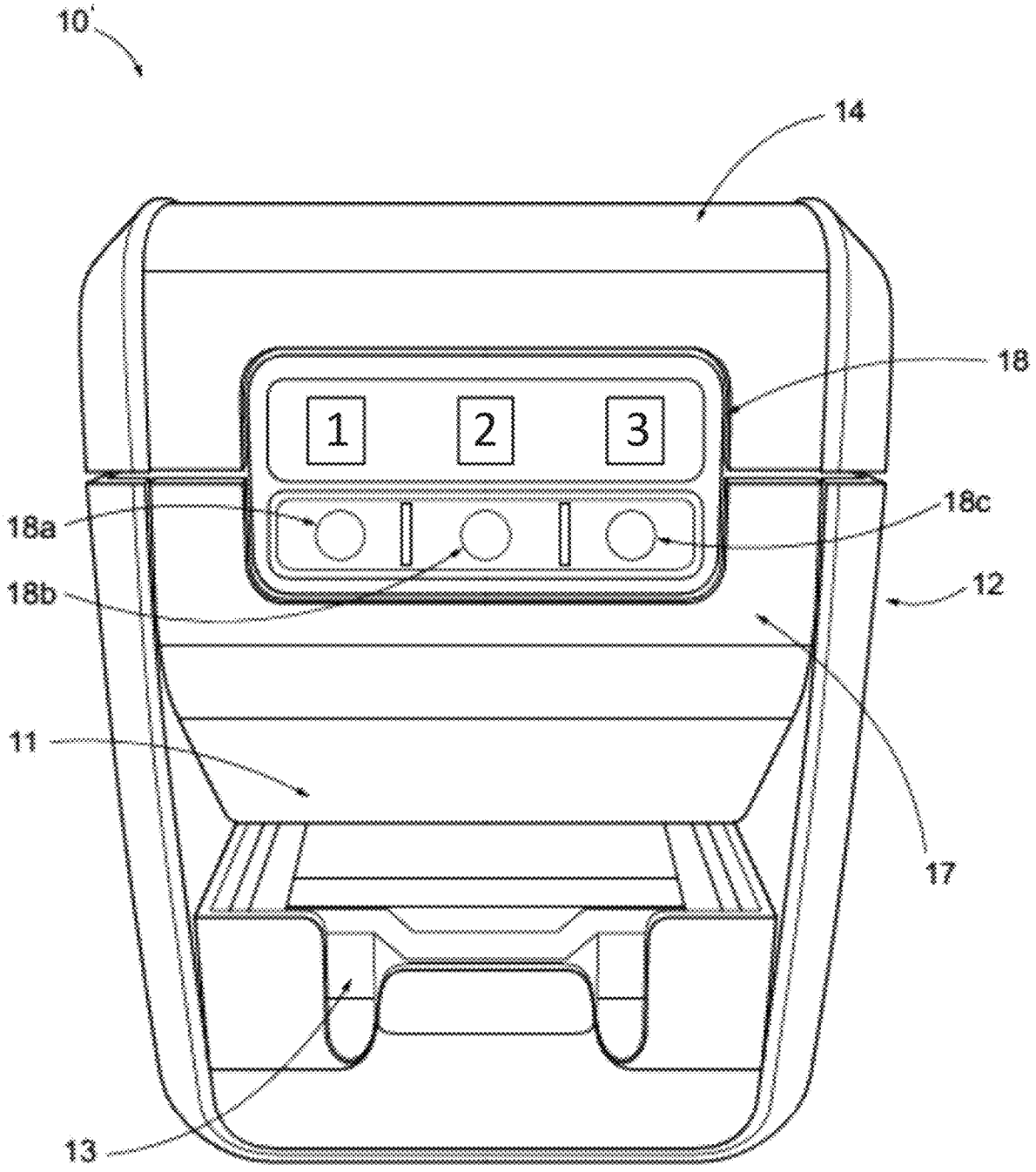
FIG. 2 shows a front view of another example napkin dispenser, in accordance with some embodiments discussed herein.

FIG. 2 shows another example sheet product dispenser (e.g., napkin) dispenser 10' that includes a user interface 18 that is visible to the end user when the cover 14 is closed (such as shown). Such an example sheet product dispenser 10' with a user interface 18 visible to the end user may be preferred for a back of the house (BOH) dispenser, such as may be present in kitchens. Alternatively, the example sheet product dispenser 10 shown in FIG. 1 may not include a user interface that is visible to the end user, which may be preferred for a front of the house (FOH) dispenser, such as may be present in a dining hall. The FOH dispenser may be preferred for a cleaner look and/or for less functionality so as to not confuse the end user. The BOH dispenser may be preferred for providing increased amounts of information (e.g., errors, napkin dispensing numbers, product levels, etc.) to the end user (which in some cases may also be the maintainer).

In the depicted embodiment of FIG. 2, the sheet product dispenser 10' includes a user interface 18 (e.g., the user interface 200 described with respect to FIG. 12). The user interface 18 is positioned on a front portion 17 of the sheet product dispenser 10' such that it is prominently displayed for viewing by the end user. The user interface 18 includes a screen that is configured to display information to the end user, such as through three 7-element displays. The user interface 18 also includes one or more buttons (e.g., buttons 18*a*, 18*b*, and 18*c*) that enable user input. In the depicted example, a user may choose how many napkins are to be provided each time a dispense occurs by selecting the button that corresponds to the desired number. For example, selection of button 18*a* results in 1 napkin being provided with each dispense, selection of button 18*b* results in 2 napkins being provided with each dispense, and selection of button 18*c* results in 3 napkins being provided with each dispense. In some embodiments, the buttons 18*a*-18*c* may be programmed to correspond to different numbers for napkin selection (or other feature selection). For example, the buttons 18*a*-18*c* could be programmed to correspond to 6, 4, 2, respectively, or 9, 9, 9, respectively.

Figure 3:
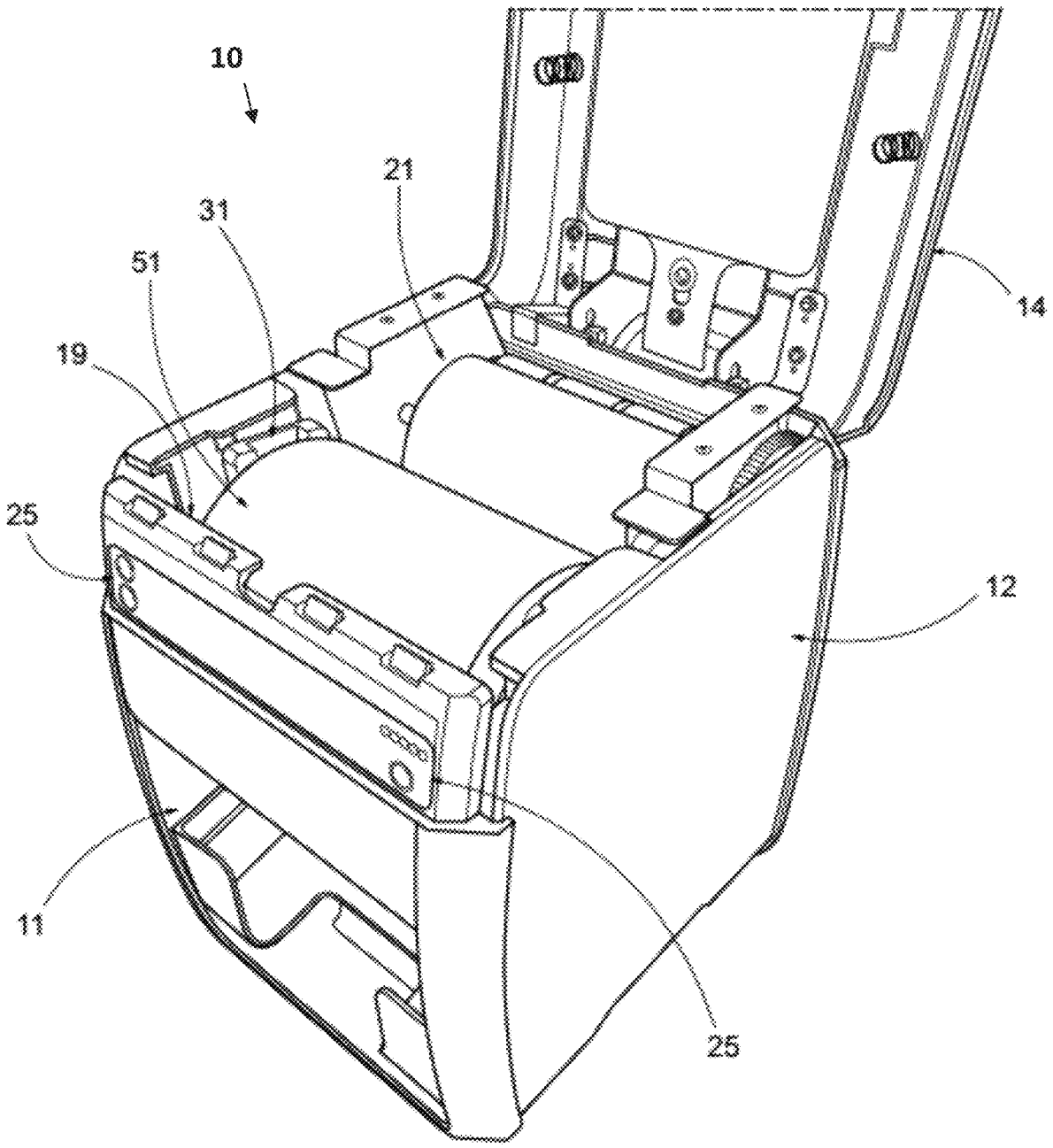
FIG. 3 shows a perspective view of the example napkin dispenser of FIG. 1 with a cover open, in accordance with some embodiments discussed herein.

FIG. 3 illustrates an example sheet product dispenser 10 with the cover 14 open. With the cover 14 open, a maintainer user interface 25 is now visible (e.g., a user interface 200 such as described with respect to FIG. 12). In some embodiments, such as in a FOH dispenser, the maintainer user interface 25 may be the only user interface. In some other embodiments, such as in a BOH dispenser, the user interface 18 and the maintainer user interface 25 may both be present, with each one, in some cases, providing different information and/or functionality.

Figure 5:
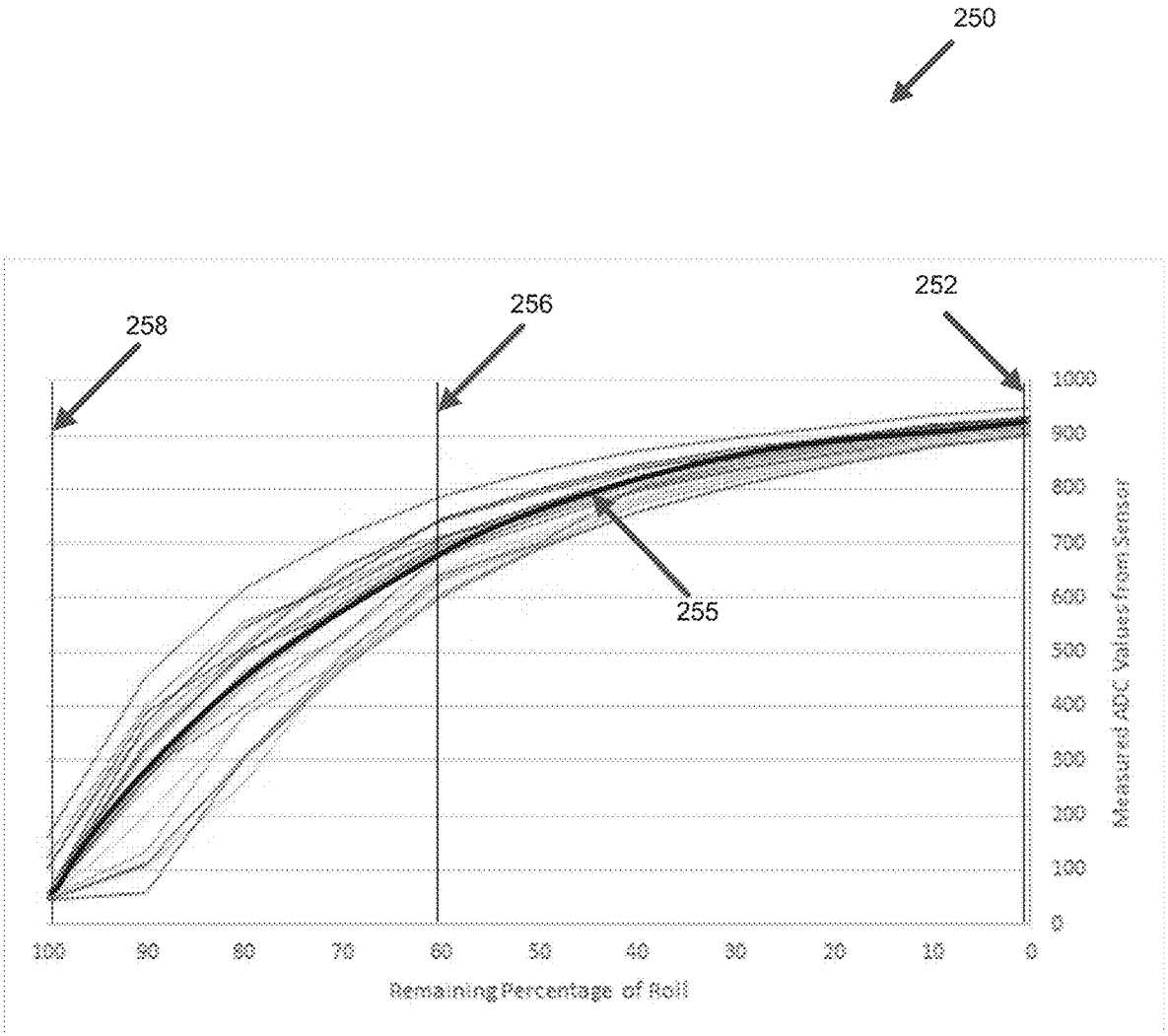
FIG. 5 illustrates an example graph with a product depletion curve, in accordance with example embodiments described herein.

With reference to FIG. 5, the maintainer user interface 25 may include one or more buttons for receiving user input. For example, the maintainer user interface 25 may include a feed button 87 that operates the dispensing mechanism (e.g., loading mechanism) to feed sheet product through the dispenser, such as for dispensing. Such a feed button 87 may be useful for loading sheet product and/or clearing jams. Likewise, the maintainer user interface 25 may include a reverse feed button 88 that reverses the direction of operation of the dispensing mechanism, such as may be useful for clearing jams. As will be described in greater detail herein, the maintainer user interface 25 may also include a calibration button 45 that may initiate a calibration process. In some embodiments, the above described buttons may be present on the user interface 18 so as to be actuable by the end user even when the cover is closed.

The maintainer user interface 25 may include one or more displays or visual indicators, such as LEDs. In the depicted embodiment, the user interface 25 includes 5 LEDs (although only three will be highlighted herein). As will be described in greater detail herein, the LEDs may be used to provide indications to the user, such as during the calibration process and/or to communicate amount of product remaining information (e.g., a LOW fuel alert or CRITICAL fuel alert, or the like). In some embodiments, the above described displays or visual indicators may be present on the user interface 18 so as to be visible by the end user even when the cover is closed.

Turning back to FIG. 3, the example sheet product dispenser 10 may include one or more roll holders 31 that are configured to receive and hold a corresponding product roll 51 of sheet product. The sheet product of the product roll 51 may be fed through one or more dispensing mechanisms 21 which, as described with respect to FIG. 12, may include components that enable dispensing of the portion of the corresponding sheet product roll. For example, the dispensing mechanism 21 may include one or more motors that drive one or more rollers to pull the sheet product from the product roll 51. The dispensing mechanism 21 may also include a folding mechanism and/or cutting mechanism that is configured to fold and/or cut the sheet product. Further, the dispensing mechanism 21 may include a presentation mechanism, such as one or more rollers, that feed the portion of the sheet product to the end user (such as into tray 13). Such a process may be initiated by an end user activating a dispense (e.g., through user input provided to an activation sensor).

As described in greater detail with respect to FIG. 12, the sheet product dispenser 10 may include a controller. The controller may be configured to communicate with and/or operate various components of the sheet product dispenser 10. For example, the controller may be configured to initiate a dispense. In some embodiments, the controller may be positioned on one or more printed circuit boards (PCBs). In the depicted embodiment, the PCB is housed within an inside wall 19 of the housing of the sheet product dispenser. Such positioning provides preferred placement for easy access to desired functionality of the sheet product dispenser. For example, the PCB is near the front wall 17 of the sheet product dispenser 10 and the corresponding one or more user interfaces 18, 25. The PCB is also separate from the cassette (e.g., the dispensing mechanism and/or other components), which enables easy replacement of the cassette (or its various components), without a need to replace the PCB. In such embodiments, information, such as calibration data and/or user preferences specific to that sheet product dispenser, may be retained within memory positioned on the PCB even when replacement of the cassette, portions of the cassette, or other parts is necessary. This prevents the need to re-calibrate the sheet product dispenser or reenter user preferences.

Figure 4:
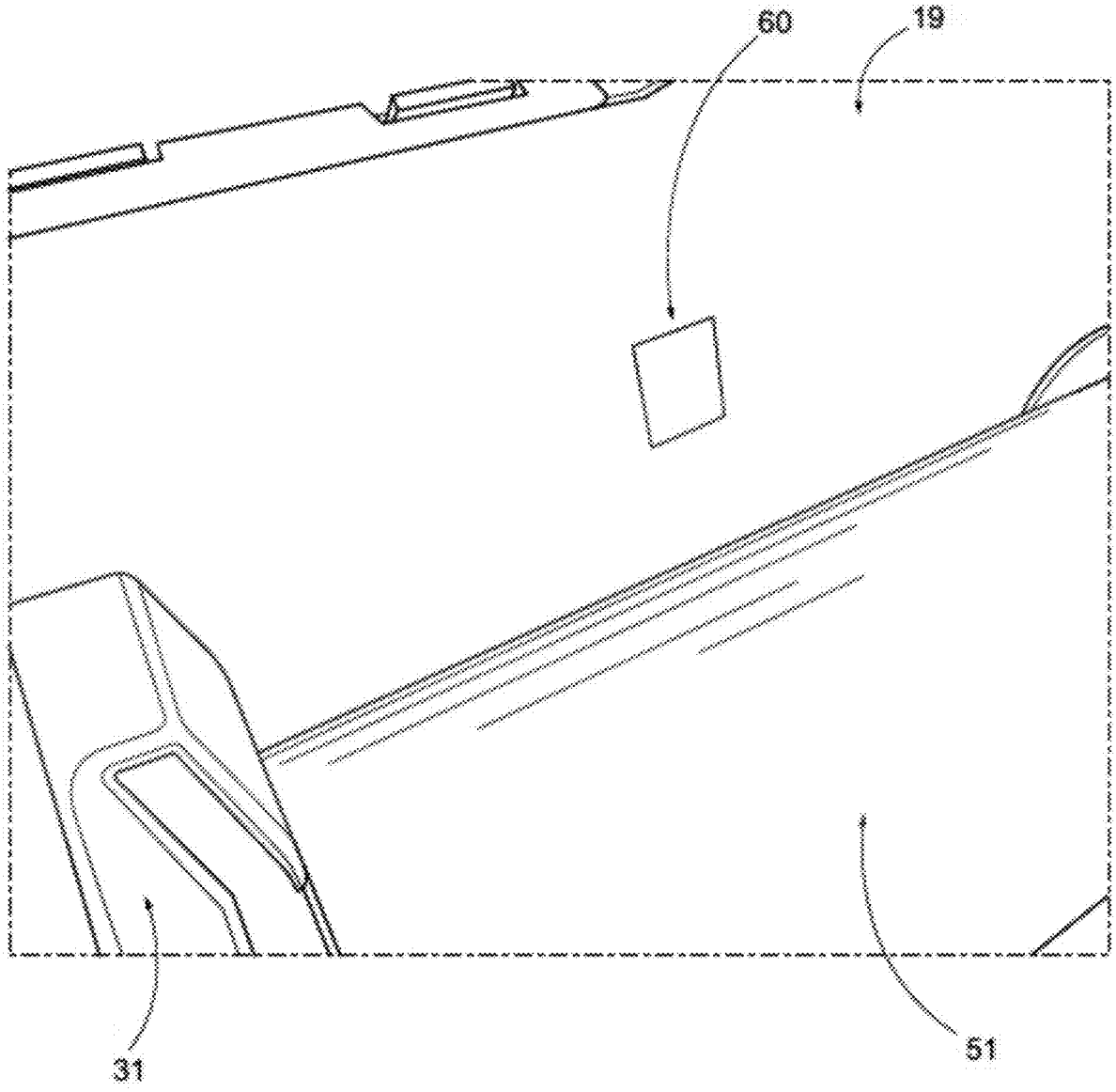
FIG. 4 illustrates a close up view of an example product level sensor and product roll within an example napkin dispenser, in accordance with some example embodiments discussed herein.

In some embodiments, the sheet product dispenser may include one or more product level sensors (e.g., product sensors 205 of FIG. 12) configured to determine the amount of product remaining on a product roll. In some embodiments, the product level sensors may be infrared (IR) sensors, ultrasonic sensors, or the like. In some embodiments, the product level sensor may be positioned within the sheet product dispenser 10 to enable interaction with one or more product rolls 51 so as to enable determination of an amount of product remaining on the product roll. For example, FIG. 4 shows that the product level sensor 60 may be positioned on the inside wall 19 of the sheet product dispenser 10 and oriented toward the product roll 51.

Figure 7A:
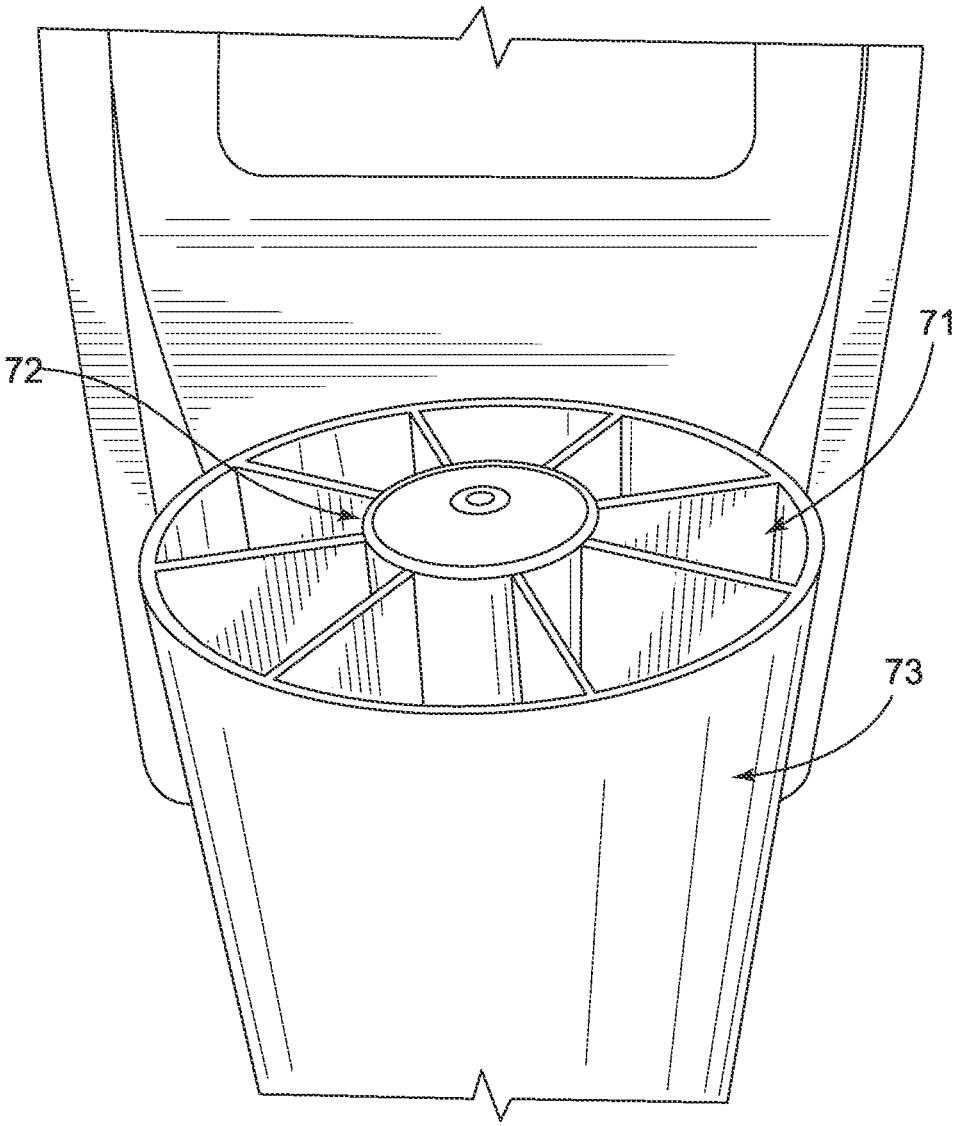
FIG. 7A shows an example calibration roll that is representative of a product roll with 100% product remaining, in accordance with example embodiments described herein.
Figure 7B:
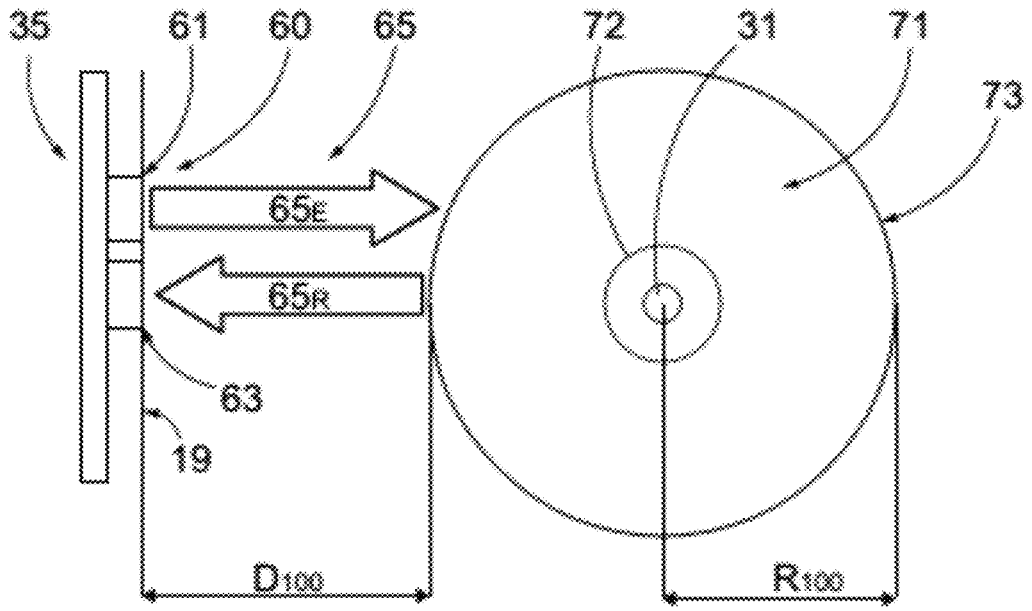
FIG. 7B illustrates a cross-sectional view of an example product level sensor emitting a signal toward and receiving a return signal from an example calibration roll with 100% product remaining, in accordance with example embodiments described herein.

With reference to FIG. 7B, the product level sensor 60 may be an infrared (IR) sensor that includes at least one IR emitter 61 and at least one IR receiver 63. In the depicted embodiment, the IR emitter 61 and IR receiver 63 may be attached to the PCB 35 and aimed toward the product roll (e.g., calibration device, such as a calibration roll 71, as will be described in greater detail herein). The product level sensor 60 is configured to emit a signal $\mathbf{65}_E$ from the IR emitter 61 that travels toward the product roll (e.g., calibration roll 71). The signal will (if the product roll is present) reflect off of an external surface of the product roll (e.g., the outer circumferential surface 73 of the calibration roll 71). The reflected signal $\mathbf{65}_R$ is then sensed by the IR receiver 63 of the product level sensor 60. While the depicted example embodiment shows the product level sensor positioned on the inside wall 19, other suitable locations are contemplated (e.g., on the cover 14, on other portions of the housing, etc.).

In some embodiments, the product level sensor 60 (such as through the IR receiver 63) and/or the controller is configured to determine a brightness value (e.g., an amount of light) received via the return signal. For example, the controller and/or product level sensor may be configured to measure a voltage level received with the return signal, where the voltage level may be indicative of the brightness value of the return signal. The controller and/or product level sensor may also be configured to determine a corresponding amount of product remaining on the product roll based on the brightness value of the return signal. To explain, the emitted signal from the IR emitter may have a known brightness value. As the signal travels toward the product roll, reflects off the surface of the product roll, and travels back to the IR receiver, the signal may lose brightness. For example, portions of the light of the signal may reflect in different directions and/or be absorbed or diluted along the way (such as being absorbed into the product roll). The result of this is that the return signal, when received by the IR receiver, may have less of a brightness value than the originally emitted signal.

In some embodiments, the brightness value can be correlated to the distance to the product roll, which may result in being able to determine the radius of the product roll if the product roll is always in the same position with respect to the product level sensor. In this regard, based on the reduction in brightness value between the received return signal and the emitted signal, a distance of travel of the signal can be determined and used to estimate the radius of the product roll, which can be used to estimate the amount of product remaining on the product roll. For example, with reference to FIGS. 7B and 8B, the distance between the product level sensor 60 and the roll holder 31 (which corresponds to the center of the product roll) may be constant. However, as the amount of product on the product roll decreases the distance the signal travels increases (e.g., $D_{100}$ in FIG. 7B versus $D_{60}$ in FIG. 8B) to reflect off the surface of the product roll (since the surface of the product roll moves further away from the product level sensor as the product is depleted). With increased distance of travel, the signal loses more brightness value, which enables a correlation that can result in estimating the amount of product remaining on the product roll (e.g., the radius $R_{100}$ in FIG. 7B is greater than the radius $R_{60}$ in FIG. 8B).

Though the above described embodiment utilizes a roll of the sheet product, some embodiments of the present invention can be utilized with other forms of sheet product, such as stacked sheet product. For example, the product level sensor may be configured to emit a signal that reflects off the stacked sheet product and is received accordingly. In some embodiments, the product level sensor may be configured to emit a signal that reflects off a plate (or other feature) that controls the position of the stacked sheet product (e.g., a spring-loaded plate the pushes the stacked sheet product towards a dispensing slot). The distance the signal travels may correlate to the measured brightness value of the return signal. In such a manner, as the stack of sheet product depletes, the distance the signal travels may increase and, thus, the brightness value may decrease accordingly.

Using, for example, the above described correlation between measured brightness value and product level remaining, a product depletion curve can be formed to enable determination of the estimated amount of product remaining on a product roll. For example, FIG. 5 shows a graph 250 with a product depletion curve 255. In the depicted graph, a number of different product depletion curve examples were produced to form an ultimate or master product depletion curve 255. With reference to the graph 250, the amount of product remaining may be represented as a percentage of product remaining on the x axis. The brightness value may be represented on the y axis as a measured ADC value from the product level sensor that corresponds to the brightness value of the return signal. In some embodiments, the ADC value may be a ratiometric value for an Analog-to-Digital Converter. The product depletion curve may have a generally parabolic curve due to the nature of the decreasing radius of the product roll as the sheet product is dispensed from the product roll.

In some embodiments, the product depletion curve may form a slope that is based off one or more pre-determined calibration factors (e.g., a calibration constant) and/or one or more designated formulas. In some embodiments, a designated formula may apply one or more calibration factors to brightness values that correspond to one or more calibration values to adjust the product depletion curve to be applicable for a specific dispenser. In some embodiments, the calibration factor and/or formula may have been determined by measuring and forming product depletion curves over a significant number of dispensers, and averaging their brightness values at specific percentage steps (e.g., every 10% product remaining). In some embodiments, the product depletion curve may be adjusted (using a calibration routine) to form a table of look-up values to help the controller determine a level of product remaining based on measured brightness values for a given dispenser. In some embodiments, the table of look-up values may correspond to specific percentage steps of product remaining (e.g., every 5%, 10%, etc.). In some embodiments, each step may have a corresponding brightness value (or range of brightness values).

In some embodiments, the controller and/or product level sensor may be configured to determine the brightness value of the return signal and look up the corresponding amount of product remaining using a saved product depletion curve (e.g., a stored table), such as may be specific to that sheet product dispenser). In some embodiments, the controller may use the look-up table to determine a corresponding percentage for the measured brightness value. In some embodiments, such a percentage could correspond to a specific percentage step that is associated with a range of brightness values. For example, the controller may determine that the measured brightness value is a measured ADC value of 475. Using the product depletion curve 255 shown in FIG. 5, the controller may determine that the measured brightness value corresponds to a range of brightness values that are associated with 80% of the amount of product remaining on the product roll. In some embodiments, such information may be transmitted (e.g., through a communication interface) to a remote server. Such information could be transmitted routinely, such as after every measurement and/or in response to an event (e.g., a reduction in product remaining (such as every 10% reduction), reaching a CRITICAL or LOW fuel range remaining, user input to a data transmission button, among many others).

Additionally or alternatively, in some embodiments, the controller may be configured to determine a percentage that may be between two percentage steps. Such a determination may be made, for example, by calculating an intermediate percentage between the two percentage steps using an assumed line between the two percentage steps (e.g., a linear line). For example, if a first percentage step was 90% and the corresponding brightness value was 900, and a second percentage step was 80% and the corresponding brightness value was 800, for a measured brightness value of 850, the controller may calculate a percentage of 85% using an assumed linear line between the 90% percentage step and the 80% percentage step. While the above example uses an assumed linear line, other sloped line assumptions are contemplated.

In some example embodiments, the controller may be configured to determine the remaining product level in response to a trigger event. A trigger event may include a dispense of sheet product, a predetermined number of dispenses (e.g., 5 dispenses, 10 dispenses, or the like), a predetermined interval, or other suitable event, such as closing the cover (which may indicate loading of a new product roll). In this regard, in some embodiments, the trigger event may include introduction of a calibration roll while the dispenser is in calibration mode, such as described in greater detail herein.

Figure 17:
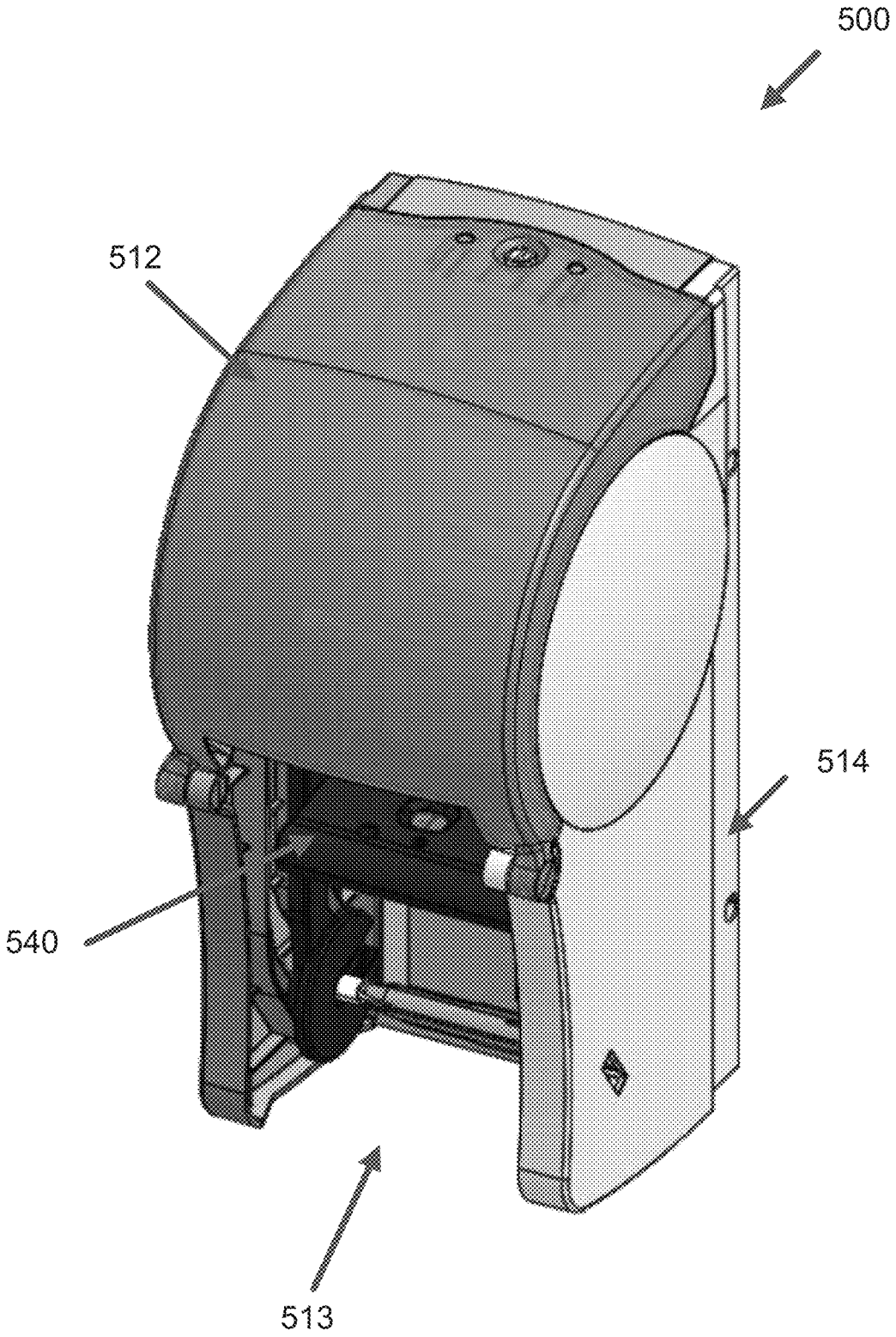
FIGS. 17-19 illustrate an example manual tissue dispenser, in accordance with some embodiments discussed herein.
Figure 18:
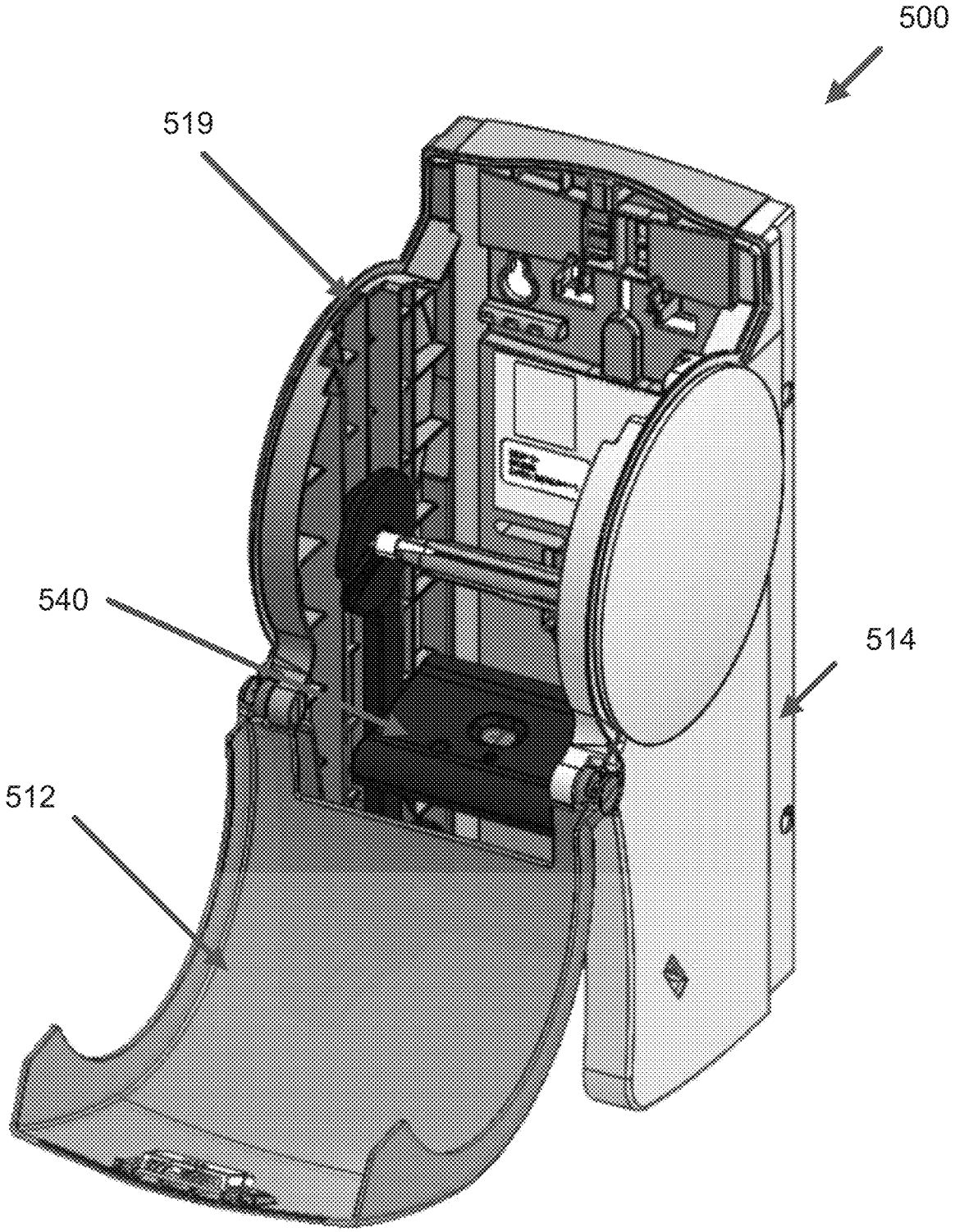
Figure 19:
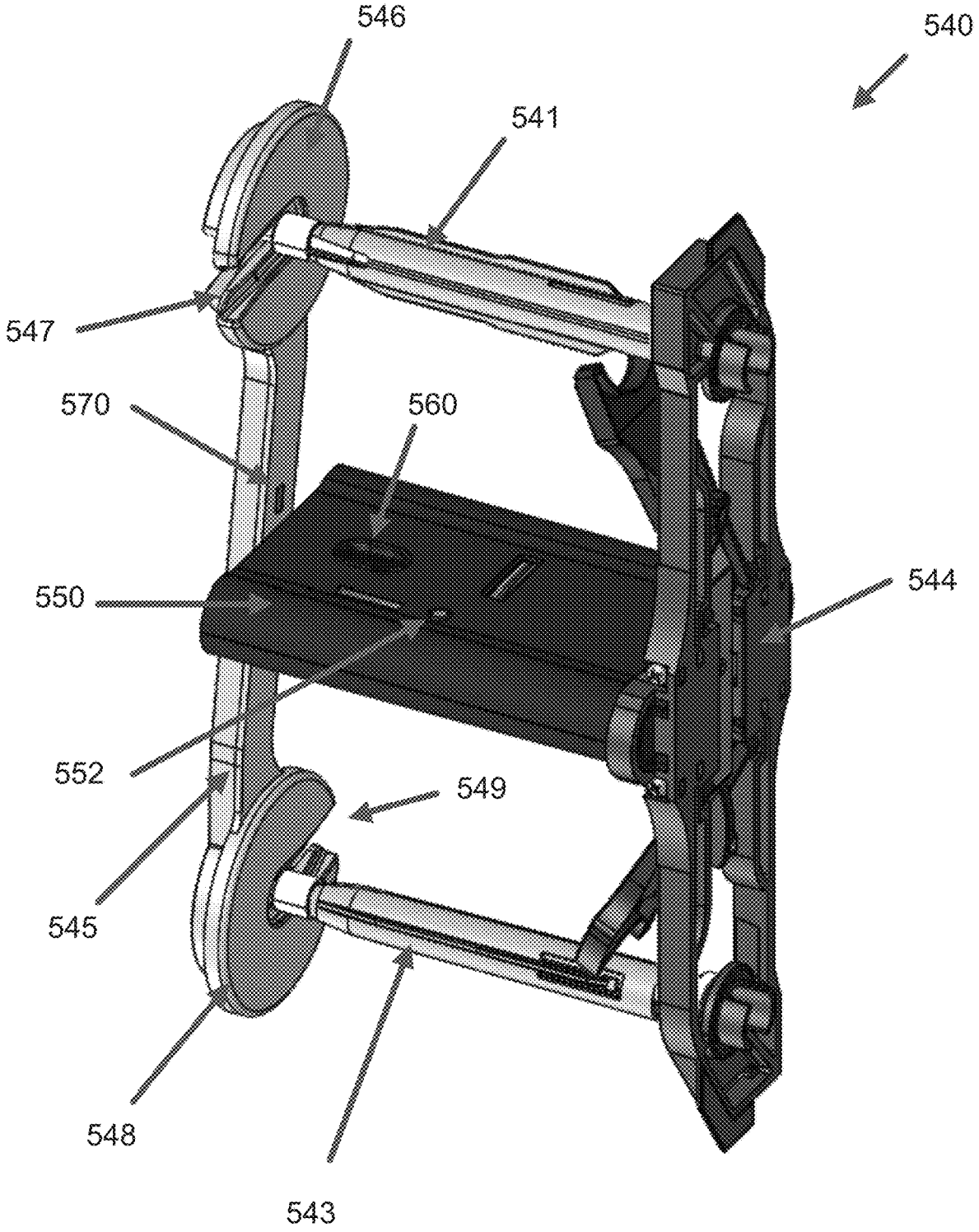

Though the above described example sheet product dispenser 10 includes a dispensing mechanism, some embodiments of the present invention may be utilized with a manual sheet product dispenser, such as a tissue dispenser where a user is responsible for removing a portion of the tissue (e.g., using perforations and/or a cutting device). For example, FIGS. 17-19 illustrate an example sheet product dispenser that is a manual tissue dispenser 500. The tissue dispenser 500 includes a housing defined by a cover 512 and a base portion 514. One or more tissue rolls are held by a holding mechanism 540. At least one tissue roll is accessible by a user through a dispensing opening 513 in the housing. In this regard, a user may access the tissue roll and remove (e.g., tear off) a portion thereof for use. Such removal may be facilitated by one or more perforations on the tissue roll.

With reference to FIG. 18, the holding mechanism 540 may be removed from the housing by a user opening the cover 512 and moving the holding mechanism 540 along a track 519 such that the holding mechanism 540 is completely removed from within the housing (such as shown in FIG. 19). With reference to FIG. 19, the holding mechanism may include a base portion 544, a center portion 550, and a rotatable arm 545. A first roll holder 541 may extend from the base portion 544 and be received in a first slot 547 of a first end 546 of the rotatable arm 545. The first roll holder 541 may include a spindle or other feature that is configured to hold/receive a first tissue roll (not shown). A second roll holder 543 may extend from the base portion 544 and be received in a second slot 549 of a second end 548 of the rotatable arm 545. The second roll holder 543 may include a spindle or other feature that is configured to hold/receive a second tissue roll (not shown).

The center portion 550 of the holding mechanism 540 may define a shape that enables holding of one or more sensors and/or controllers, such as one or more printed circuit boards (not shown). In the depicted embodiment, the center portion 550 is sized to hold a first printed circuit board (not shown) facing generally toward the first roll holder 541 and a second printed circuit board (not shown) facing generally toward the second roll holder 543. The center portion 550 may also house a first product level sensor 60 facing generally toward the first roll holder 541 and a second product level sensor (not shown) facing generally toward the second roll holder 543. In this regard, as similar to various product level sensors described herein, each product level sensor may be configured to emit a signal toward a corresponding tissue roll and receive a return signal therefrom. Additionally, the center portion 550 includes a button 552, such as may be used to indicate a user's desire to enter a calibration mode (such as described herein). Additionally, though not shown, the center portion 550 (or another portion of the dispenser) may include one or more LEDs, such as for communicating information to a user.

In the depicted embodiment, the rotatable arm 545 also includes one or more rotation sensors 570. The one or more rotation sensors 570 may be configured to determine the position of the rotatable arm 570. For example, the rotation sensor 570 may be used to determine when the rotatable arm 570 is in a closed position such that the roll holders 541, 543 are held within their respective slots 547, 549 (e.g., as shown in FIG. 19) or when the rotatable arm 570 is in an open position such that the roll holders 541, 543 are not held within their respective slots 547, 549 and able to receive tissue rolls thereon.

Though the first described example sheet product dispenser 10 includes a single product roll, some embodiments of the present invention contemplate use of various features herein (such as the calibration system and method) with dispensers that include more than one product roll or stored supply of sheet product.

Example Calibration Systems and Methods

In some embodiments, the controller 215 may be configured to adjust the product depletion curve 255, such as to compensate for variance in the product roll and/or the construction of the sheet product dispenser 10. In some embodiments, the controller 215 may be configured to enter a calibration mode to enable a user to interact with and cause adjustment of the product depletion curve 255. In this regard, some embodiments of the present invention contemplate an easy to use calibration process for a maintainer to calibrate the product level sensor for the specific sheet product dispenser. In some embodiments, the maintainer may calibrate the product depletion curve depending on which color sheet product is used (e.g., the maintainer may switch between brown and white paper).

In some embodiments, the calibration for each color sheet product roll may be stored and called up again if a switch back to that color sheet product occurs. For example, the controller may be configured to apply a color offset to the adjusted product depletion curve for the specific dispenser. In this regard, a user may be able to communicate the color of the sheet product being used and, depending on the color, the controller may apply the color offset (or use a pre-stored product depletion curve/table that was formed using the color offset) to more accurately determine the amount of product remaining.

The following provides a description of one or more example calibration processes, however, other calibration methods and variations thereof are also contemplated.

Figure 6:
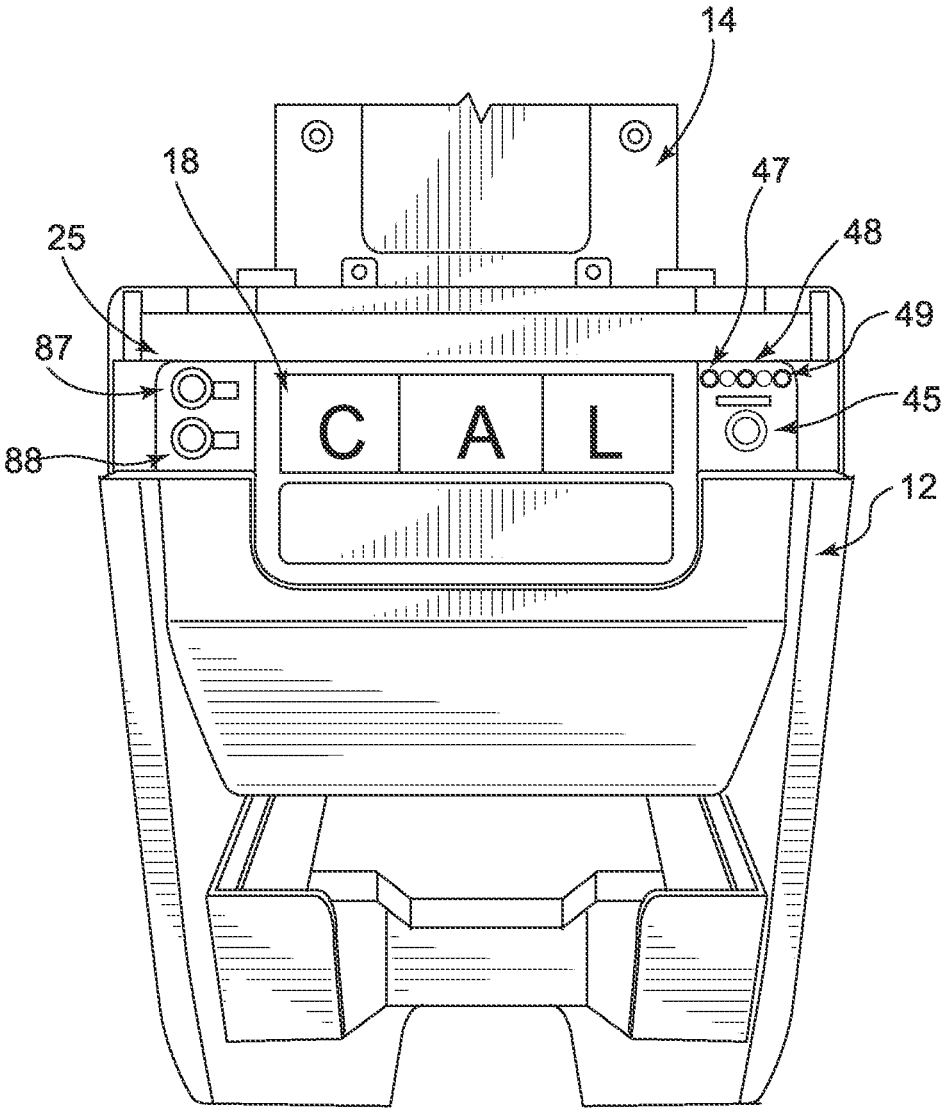
FIG. 6 shows a front view of an example napkin dispenser with a cover open, wherein a user interface indicates that the napkin dispenser is in a calibration mode, in accordance with example embodiments described herein.

FIG. 6 shows a sheet product dispenser with the cover 14 open and the maintainer user interface 25 exposed. In such a configuration, a maintainer may provide user input indicating a desire to enter calibration mode, such as by pressing a calibration button 45. In response, the controller may cause the sheet product dispenser to enter a calibration mode. In some embodiments, other user input(s) may be required to cause calibration (or re-calibration) to occur. For example, a user may need to hold a magnet in front of a door close sensor in order to enable calibration to begin. Such a scenario provides an additional layer of protection to avoid inadvertent re-calibration. Additionally or alternatively, a user may be required to provide user input to two or more buttons at the same time—such as may help avoid inadvertent re-calibration. However, if re-calibration does occur, in some embodiments, a power cycle can be used to revert certain configured controllers to a previous calibration.

In some embodiments, depending on the configuration of the dispenser, other ways are contemplated to enter calibration mode. For example, with reference to FIGS. 17-19, a manual tissue dispenser may enter calibration mode automatically upon power-up. For example, after power-up, a controller may determine that no calibration data exists and, in response, automatically enter calibration mode. Such an example entrance into calibration mode may be utilized with any type of dispenser. As another example, a user may provide input to button 552 on the holding mechanism 540 of the manual tissue dispenser 500 to indicate a desire to enter calibration mode. In some embodiments, the rotatable arm 545 may be required to be in the open position for the button 552 input to cause entrance into the calibration mode.

In some embodiments, in calibration mode, the user interface 25/18 (such as through the controller) may display instructions and/or information to the maintainer. For example, the screen may display "CAL" to indicate that the dispenser is in calibration mode. As another example, three LEDs 47, 48, 49 may illuminate to provide an indication of which calibration rolls are needed to complete the calibration process. In this regard, the calibration process may involve inserting one or more calibration rolls into the dispenser to help calibrate and adjust the product depletion curve to account for specific dimensions and characteristics of the sheet product dispenser.

In some embodiments, the planned calibration process may involve inserting and checking the brightness value for one or more calibration devices (e.g., calibration rolls). Then, the controller may adjust the product depletion curve based on the difference between the measured brightness values and the corresponding expected brightness values. Such an adjustment may be based on a number of factors and applied in many different ways, such as by averaging the differences from among the different calibration devices, etc.

In some embodiments, there may be three calibration rolls that are each designed with a specific radius that equates to (1) a product roll with 100% product remaining, (2) a product roll with 60% product remaining, and (3) a product roll with 0% product remaining—though other % product remaining values may be utilized. Likewise, any number of calibration rolls may be used in the calibration process. In some embodiments, the pre-defined calibration rolls may be provided to the maintainer. As described herein, the notation of a percentage number (e.g., 0%) is not meant to be limiting and, instead, is meant as an approximation that may or may not factor in certain desired tolerances. For example, 0% remaining may equate to a certain amount of product still remaining on the roll (such as may be designed to avoid, for example, a completely empty scenario).

FIG. 7A shows an example first calibration roll 71 that equates to a product roll with 100% product remaining. In some embodiments, the calibration roll may have at least one or two sheets of sheet product wrapped around the outer circumference to mimic the absorption characteristics of a sheet product roll. As shown, the first calibration roll 71 has a core 72 and an outer surface 73 and a radius $R_{100}$ (shown in FIG. 7B). A user may insert the first calibration roll 71 into the roll holders 31 and perform an action—such as close the cover 14 or press a button—to indicate that the product level sensor should operate (though a sensor may determine insertion of the calibration roll automatically). With reference to FIG. 7B, the controller may be configured to cause the product level sensor 60 to operate to cause a signal 65 to be emitted $\mathbf{65}_E$ by the IR emitter 61 toward the first calibration roll 71. The signal 65 will travel a distance $D_{100}$ and reflect off the surface 73 of the first calibration roll 71, and a return signal $\mathbf{65}_R$ will be received by the IR receiver 63. The controller may then measure/determine the brightness value of the return signal.

In some embodiments, the controller may be configured to determine which calibration roll (e.g., the 0%, the 60%, or the 100%) has been entered by determining if the measured brightness value falls within a range of brightness values that corresponds to one of the possible calibration values (e.g., 0%, 60%, or 100%)—each calibration value corresponding to a calibration roll. In such an embodiment, each calibration value may have a corresponding range of brightness values that may be possible. For example, the calibration value of 100% product remaining may have a range of brightness values of 0 to 200 ADC value; the calibration value of 60% remaining may have a range of brightness values of 500 to 800 ADC value; and the calibration value of 0% remaining may have a range of brightness values of 850 to 1000 ADC value. In this regard, the range of brightness values may each be different and not share any brightness values, such that a determination of which calibration value can be easily achieved. As an example, if the controller measures the brightness value as 100 ADC, it may determine the calibration value of 100% product remaining. In some embodiments, another approach may be to wait for all three brightness values to be measured, and then assign the lowest brightness value to the 0% product remaining calibration value, the highest brightness value to the 100% product remaining calibration value, and the middle brightness value to the 60% product remaining calibration value.

Although some of the embodiments described herein use relative terms of highest, lowest, etc., some embodiments of the present invention contemplate other relative terms, values, and/or relationships. For example, in some embodiments, the brightness values may be inverted with respect to the percentage of sheet product remaining (e.g., 100% product remaining may correspond to a lower brightness value as compared to the brightness value for 0% product remaining).

In some embodiments, the controller may be configured to adjust the product depletion curve. For example, in some embodiments, the controller may move the product depletion curve such that the calibration value of 100% now corresponds with the measured brightness value of 100 ADC value. For example, the shape of the product depletion curve may remain the same, but simply shift up or down. In some embodiments, the adjustment to the product depletion curve may be performed by fitting the product depletion curve (or a portion of the product depletion curve) to the measured brightness values, matching the position of the calibration value with the corresponding measured brightness value. In some such embodiments, such a process could be split up between measured brightness values that correspond to calibration values, piecing together the full product depletion curve (such as described herein). In some embodiments, bounded factors may be used to adjust the product depletion curve (such as preventing too much adjustment, limiting adjustment, selecting a different product depletion curve, or the like). In the immediately above described embodiment, only one calibration roll was utilized to calibrate the dispenser (e.g., adjust the product depletion curve). As used herein, the term "adjust" is not meant to be limiting, as some embodiments of the present invention contemplate adjustment or adjusting occurring in many different ways. For example, adjusting a product depletion curve may include applying a pre-determined product depletion curve to measured brightness values (e.g., the controller may not have a pre-stored product depletion curve that correlates to measured brightness values at first and, instead, may apply a pre-determined product depletion curve as its adjustment). Likewise, such as described herein, adjusting a product depletion curve may be construed to mean applying one or more formulas or calibration factors to form (e.g., populate) a table of look-up values that correlate measured brightness value(s) to a percentage of product remaining, wherein such a table, in some cases, is specifically calibrated for the dispenser.

In some embodiments, the controller may utilize more than one calibration roll, such as three calibration rolls— corresponding to three calibration values (e.g., 100%, 60%, and 0%). In some embodiments, since the first calibration roll 71 has been used and the corresponding brightness value measured, the controller may be configured to provide an indication to the maintainer that the 100% value has been completed. For example, an LED could be unilluminated (such as LED 47 is unilluminated in FIG. 9A). In such a manner, as the calibration rolls are successfully used, the corresponding LEDs could be unilluminated to indicate to the user that the calibration of that calibration roll was successful. Such a method could provide instruction and/or comfort to the maintainer that the calibration has progressed properly.

Figure 8A:
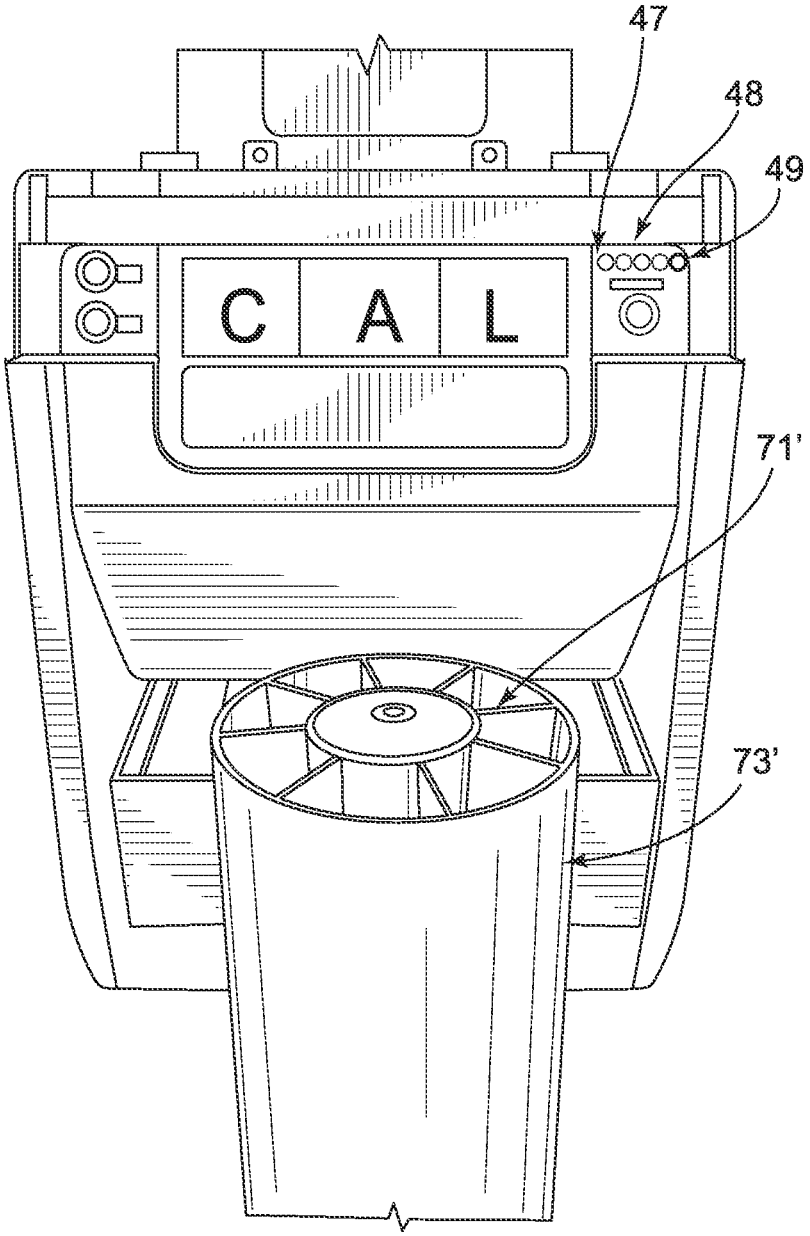
FIG. 8A shows an example calibration roll and an example napkin dispenser with a user interface, wherein the calibration roll is representative of a product roll with 60% product remaining, in accordance with example embodiments described herein.
Figure 8B:
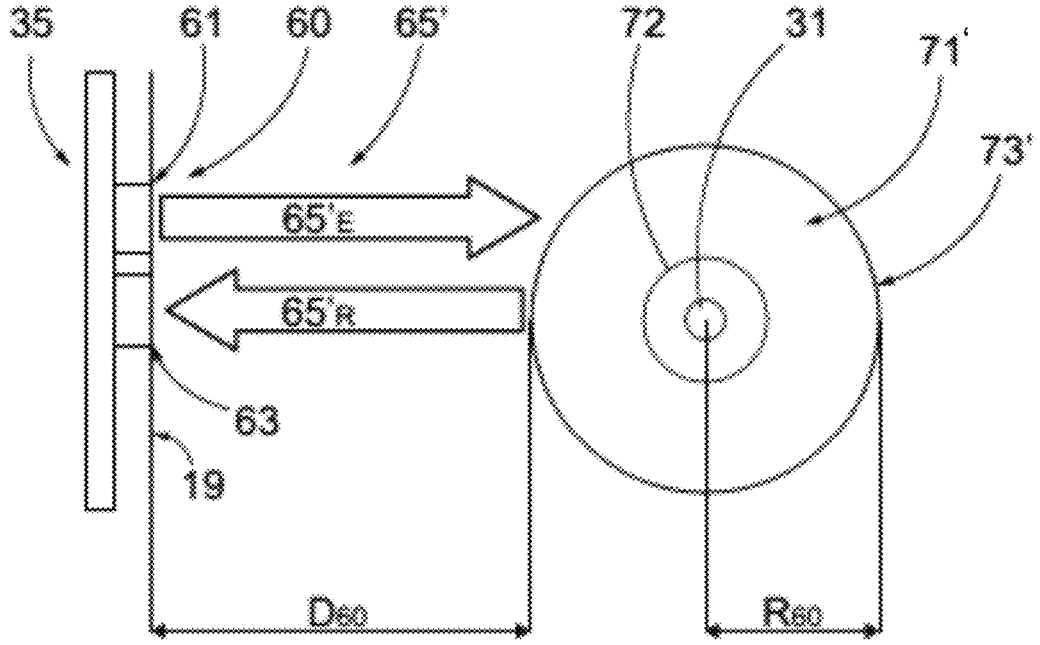
FIG. 8B illustrates a cross-sectional view of an example product level sensor emitting a signal toward and receiving a return signal from an example calibration roll with 60% product remaining, in accordance with example embodiments described herein.

FIG. 8A shows an example second calibration roll 71' that equates to a product roll with 60% product remaining. As shown, the second calibration roll 71' has an outer surface 73' and a radius $R_{60}$ (shown in FIG. 8B). A user may insert the second calibration roll 71' into the roll holders 31 and perform an action—such as close the cover 14 or press a button—to indicate that the product level sensor should operate. With reference to FIG. 8B, the controller may be configured to cause the product level sensor 60 to operate to cause a signal 65' to be emitted $\mathbf{65'}_E$ by the IR emitter 61 toward the second calibration roll 71'. The signal 65' may travel a distance $D_{60}$ and reflect off the surface 73' of the second calibration roll 71', and a return signal $\mathbf{65'}_R$ may be received by the IR receiver 63. The controller may then measure/determine the brightness value of the return signal. Additionally, the controller may determine that the measured/determined brightness value corresponds to a calibration value of 60% (such as described above). Further, the controller may determine the difference between the measured/determined brightness value and the stored brightness value that corresponds to the calibration value based on the product depletion curve (such as described above). Finally, the controller may store the measured/determined brightness value and/or the determined difference. In some embodiments, the controller may cause an indication to be presented to the maintainer indicating that the second calibration roll has been successfully utilized (e.g., the second LED 48 may be unilluminated, such as shown in FIG. 8A).

Figure 9A:
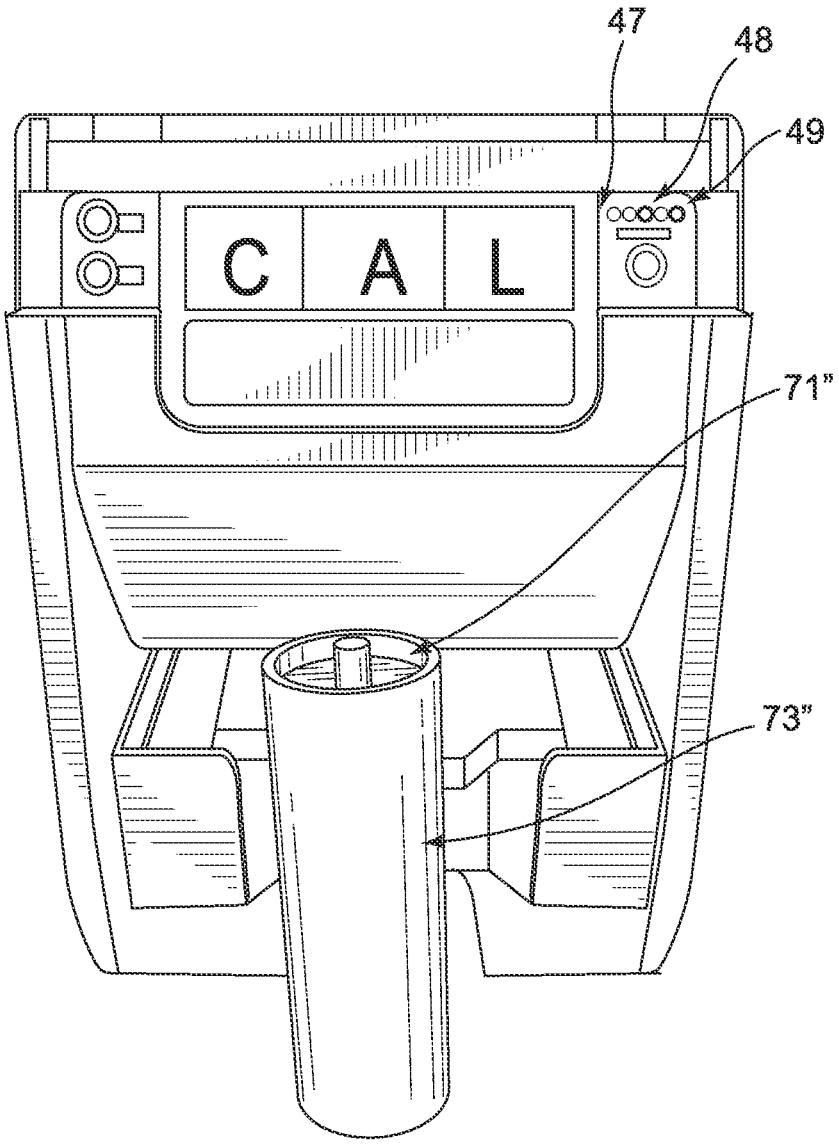
FIG. 9A shows an example calibration roll and an example napkin dispenser with a user interface, wherein the calibration roll is representative of a product roll with 0% product remaining, in accordance with example embodiments described herein.
Figure 9B:
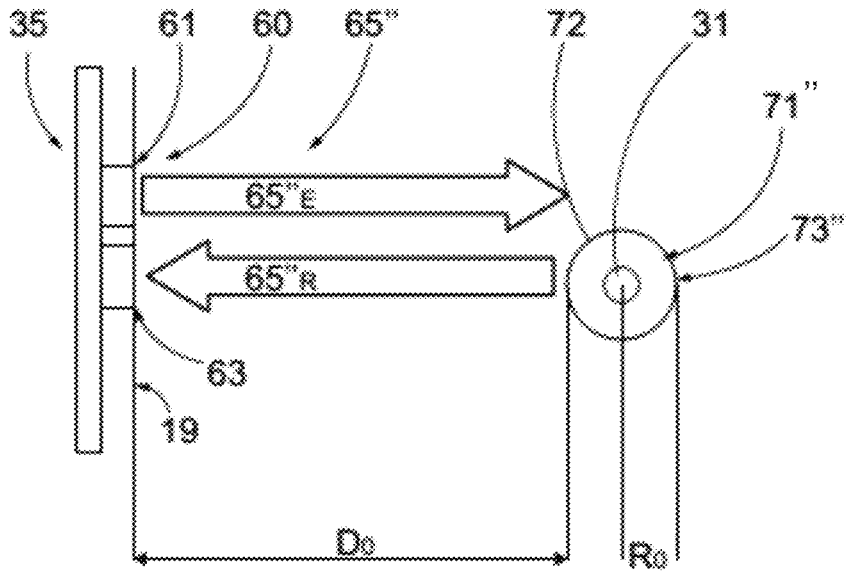
FIG. 9B illustrates a cross-sectional view of an example product level sensor emitting a signal toward and receiving a return signal from an example calibration roll with 0% product remaining, in accordance with example embodiments described herein.
Figure 10:
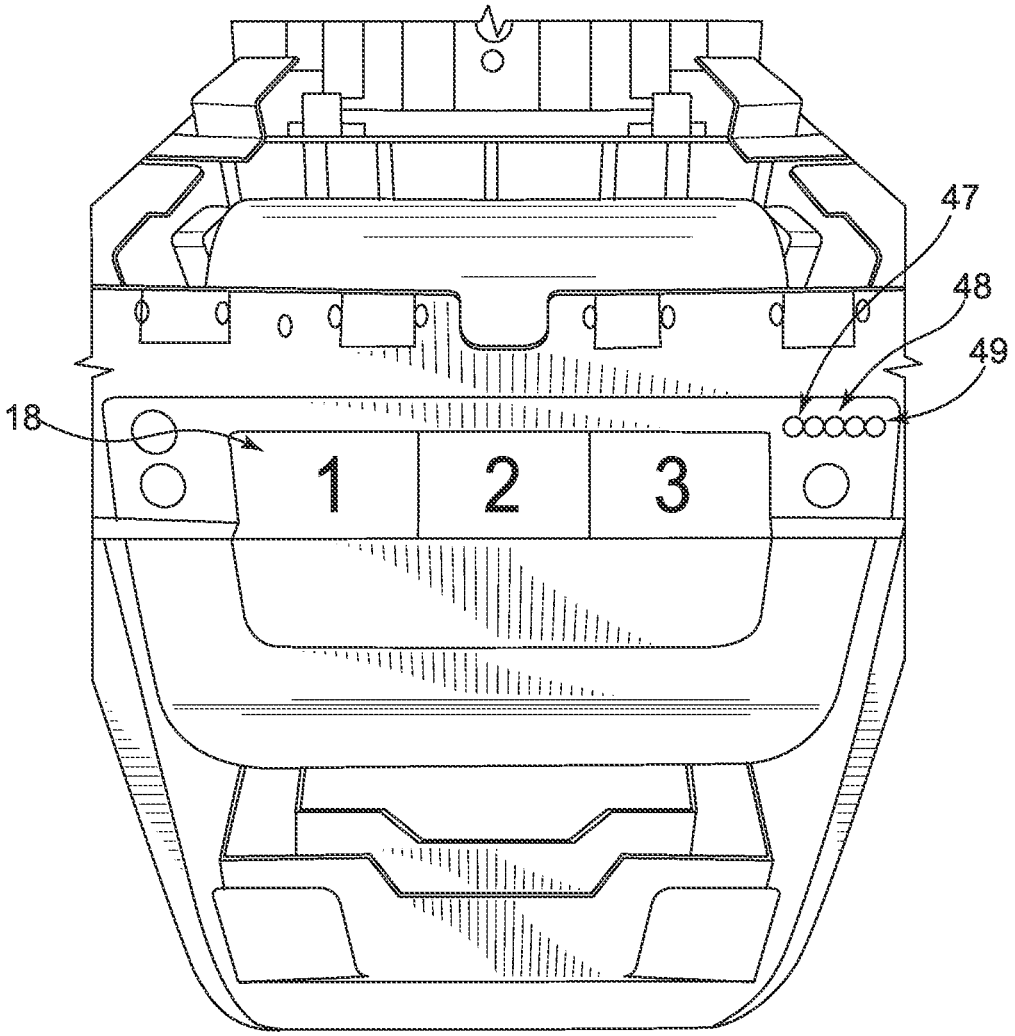
FIG. 10 shows a front view of an example napkin dispenser with a cover open, wherein a user interface indicates that the napkin dispenser has completed a calibration mode, in accordance with example embodiments described herein.

FIG. 9A shows an example third calibration roll 71" that equates to a product roll with 0% product remaining. As shown, the third calibration roll 71" has an outer surface 73" and a radius Ro (shown in FIG. 9B). A user may insert the third calibration roll 71" into the roll holders 31 and perform an action—such as close the cover 14 or press a button—to indicate that the product level sensor should operate. With reference to FIG. 9B, the controller may be configured to cause the product level sensor 60 to operate to cause a signal 65" to be emitted $\mathbf{65''}_E$ by the IR emitter 61 toward the third calibration roll 71". The signal 65" may travel a distance $D_0$ and reflect off the surface 73" of the third calibration roll 71", and a return signal $\mathbf{65''}_R$ may be received by the IR receiver 63. The controller may then measure/determine the brightness value of the return signal. Additionally, the controller may determine that the measured/determined brightness value corresponds to a calibration value of 0% (such as described above). Further, the controller may determine the difference between the measured/determined brightness value and the stored brightness value that corresponds to the calibration value based on the product depletion curve (such as described above). Finally, the controller may store the measured/determined brightness value and/or the determined difference. In some embodiments, the controller may cause an indication to be presented to the maintainer indicating that the third calibration roll has been successfully utilized (e.g., the third LED 49 may be unilluminated, such as shown in FIG. 10).

As described herein, some embodiments of the present invention provide an indication to the user of the progress of the calibration process. Some embodiments of the present invention contemplate many different ways to communicate information and/or instructions regarding the calibration process. For example, the manual tissue dispenser 500 of FIGS. 17-19 may include a single LED for communicating information (or a single LED per product level sensor). In such an embodiment, the controller may be configured to cause the LED to blink in certain patterns to communicate information/instructions to the user. For example, the controller may provide a status indication for each of the three calibration rolls. A short blink (e.g., ".") may indicate the need to insert that calibration roll, whereas a long blink (e.g., "-") may indicate that the calibration for the corresponding calibration roll has been completed. For example, when all three calibration rolls are needed for insertion the pattern may be " . . . ". However, when the middle calibration roll is the only needed calibration roll, the pattern may be "-.-". Thus, when the pattern becomes "- - - " the user knows that all the calibration rolls have been inserted properly and read (and calibration is complete). In some embodiments, the controller of the manual tissue dispenser 500 may know when to sense for a calibration roll based on when the rotatable arm 545 is moved to a closed position from an open position. In some embodiments, the controller may force calibration of both product level sensors (for each product roll) before calibration is complete.

Having acquired the measured brightness values that correspond to each of the calibration values of 0%, 60%, and 100%, the controller may then cause an adjustment of the product depletion curve. Some embodiments of the present invention contemplate many different ways to adjust the product depletion curve. Some such example ways are described herein.

In some embodiments, the controller may be configured to fit the product depletion curve (or portions thereof) to the one or more measured brightness values. For example, the product depletion curve (or portions thereof) may remain at the same slope, but be fit (using the corresponding calibration values) between points (e.g., end points) corresponding to one or more measured brightness values. For example, the controller may be configured to fit the product depletion curve between the measured brightness value corresponding to the 0% remaining calibration value and the measured brightness value corresponding to the 100% remaining calibration value. As such, thereafter, when the controller determines a measured brightness value somewhere in between, a corresponding amount of product remaining (e.g., 25%) may be determined.

In some embodiments, the controller may be configured to split the product depletion curve into portions (e.g., a first portion defined from 0% remaining calibration value to 60% remaining calibration value and a second portion defined from 60% remaining calibration value to 100% remaining calibration value). In such an example, each portion of the product depletion curve may be fit (using the corresponding calibration values) between points (e.g., end points) corresponding to one or more measured brightness values. For example, the controller may fit the first portion between the measured brightness value corresponding to 0% remaining and the measured brightness value corresponding to 60% remaining and fit the second portion between the measured brightness value corresponding to 60% remaining and the measured brightness value corresponding to 100% remaining. In such an example, the product depletion curve may have been adjusted in sections.

In some embodiments, the controller may be configured to adjust the product depletion curve such as to form (e.g., populate, calculate, determine, etc.) a look-up table that correlates percentage steps of product remaining to measured brightness values using a pre-stored calibration factor and/or formula. For example, after correlating measured brightness values to calibration values, the controller may utilize a formula to form (e.g., determine, calculate, etc.) a brightness value or range of brightness values that each correspond to a percentage step of product remaining. Such formulas could be based off a pre-stored calibration factor that may help, for example, define the product depletion curve. In some example embodiments, the controller may utilize a different formula for certain portions of the product depletion curve. For example, for the 60% remaining to 100% remaining interval, the controller may utilize a first formula that considers one or more calibration factors and the measured brightness values that correspond to the 60% remaining calibration value and the 100% remaining calibration value. Likewise, for the 0% remaining to 60% remaining interval, the controller may utilize a second formula that considers one or more calibration factors and the measured brightness values that correspond to the 0% remaining calibration value and the 60% remaining calibration value. In some embodiments, the calibration factor for each percentage step may be different. As noted above, in some embodiments, the one or more calibration factors and/or formulas may be pre-determined.

Additionally or alternatively, adjustment to the product depletion curve may, in some embodiments, be based on the difference between each of the measured brightness values and the pre-stored brightness values. In this regard, in some embodiments, the controller may determine a difference between the measured brightness value and the pre-stored brightness value for the calibration value of 100% product remaining (such as may be found using the pre-determined product depletion curve 225). In one such example, the controller may measure the brightness value as 100 ADC value, but the pre-stored brightness value for a calibration value of 100% product remaining may be 60 ADC value. In such a circumstance, the difference may be determined as an increase in brightness value of 40 ADC value. Such a difference (and the measured brightness value) may be stored in memory.

In some embodiments, the average of those differences may be used to adjust the product depletion curve (e.g., up or down). However, other adjustments are contemplated, such as the mean of the differences, median, etc. Further, bounded factors could be applied to prevent undesirable calibration, such as limiting the amount of adjustment of the product depletion curve.

In some embodiments, the controller may be configured to continuously monitor and/or adjust the product depletion curve based on measured brightness values. For example, if the controller measures a brightness value that is different than a brightness value corresponding to a calibration value, then the controller may update (e.g., re-adjust) the product depletion curve based on the newly observed calibration value. In some embodiments, the continuous (e.g., "run time") calibration process may be limited and/or restrained. As an example, if the controller measures a brightness value that is greater than the brightness value corresponding to the 0% remaining calibration value, the controller may re-adjust the product depletion curve based on the newly measured brightness value corresponding to the 0% remaining calibration value. Likewise, as another example, if the controller measures a brightness value that is less than the brightness value corresponding to the 100% remaining calibration value, the controller may re-adjust the product depletion curve based on the newly measured brightness value corresponding to the 100% remaining calibration value.

Upon completion of the calibration, the controller may be configured to provide an indication to the maintainer. For example, FIG. 10 illustrates an example sheet product dispenser with all three LEDs unilluminated. Further, the screen of the user interface 18 reads "1 2 3" which may indicate that the user should now select which number of napkins (1, 2, or 3) they would like provided with each dispense. In such a manner, the calibration and napkin number selection may form an initial set-up process.

Example Product Level Indication System and Method

In some embodiments, the sheet product dispenser 10 may be configured to provide information regarding the current product level remaining to a user and/or remote server. For example, the controller may be configured to provide data detailing the product level remaining to a remote server (e.g., through a communication interface). In some example embodiments, the controller may periodically send product level information to the remote server, such as based on time intervals (e.g., every 5 seconds, 10 minutes, etc.) and/or threshold change intervals (e.g., every 10 percent product level threshold, 5 percent product level threshold, etc.). Along these lines, in some embodiments, the product level information may be used to report when a new product roll is inserted (e.g., an increase in 25% or more product level remaining). Such information can also be reported to the remote server. In some embodiments, the data may be used to create alerts or other functions that may be useful for a maintainer, such as to help with ordering or other planning (e.g., when to replace a product roll).

In some embodiments, the controller 215 may be configured to provide an indication to the maintainer and/or end user based on the product level reaching one or more predetermined product thresholds (e.g., below 30% or below 10%). In this regard, in some example embodiments, the controller 215 may compare the remaining product level to one or more predetermined product thresholds. In an example embodiment, the controller 215 may compare the remaining product level to a first product threshold associated with a first reduced (e.g., LOW) fuel level, such as 30 percent, 25 percent, 20 percent, or the like. In some example embodiments, the controller 215 may compare the remaining product level to a second product threshold associated with a second reduced (e.g., CRITICAL) fuel level, such as 10 percent, 5 percent, 0 percent, or the like.

The controller 215 may be configured to cause one or more dispenser indicators to provide an indication to a user in response to satisfying one or more of the product thresholds. The controller 215 may cause an indicator, such as one or more light emitting diodes (LEDs), digital display, or the like, to indicate a first color or blink pattern in response to no product thresholds being satisfied, for example green or a first blink rate. The controller 215 may cause the indicator to indicate a second color or blink pattern in response to the LOW product level threshold being satisfied, such as yellow, a fast blink rate, two pulses or the like. The controller 215 may cause the indicator to indicate a third color or blink pattern in response to satisfying the CRITICAL product threshold, such as red, a faster blink rate, four pulses, constant illumination, or the like. Other variations and/or combinations are also contemplated.

Additionally or alternatively, the controller 215 may be configured to cause an alert in response to satisfying one or more of the product level thresholds. The alert may be an audio or visual indication of the product level or that the product level threshold has been satisfied. The controller 215 may cause the alert at the sheet product dispenser or may transmit an alert (such as through data) to a remote computing device, such as a maintenance service computing device, computer workstation, maintenance kiosk, mobile computing device, smart phone, laptop, tablet computer, or the like.

In some embodiments, the controller 215 may be configured to provide an indication of the product level remaining in a non-invasive (or less invasive) manner. For example, the controller 215 may provide an indication only after occurrence of a dispense and only for a limited duration of time. For example, after a dispense, the controller 215 may determine that the product level remaining is within the LOW fuel range and, accordingly, cause an LED to blink twice. Likewise, after a dispense, the controller 215 may determine that the product level remaining is within the CRITICAL fuel range and, accordingly, cause an LED to blink four times. In such a manner, the appropriate information is communicated, but not constantly (e.g., over an infinite amount of time) and only while a user is likely present (e.g., right after a dispense).

In some embodiments, the sheet product dispenser may be configured to enable the product indication system to be disabled such that no indication regarding a LOW or CRITICAL product level remaining is provided to the end user. Such a situation may be desirable to avoid an end user thinking that the dispenser is broken or there is an error (e.g., with an FOH dispenser). In some embodiments, regardless, the dispenser may still provide product level information to a remote server (which can in turn provide alerts to the maintainer).

Figure 11A:
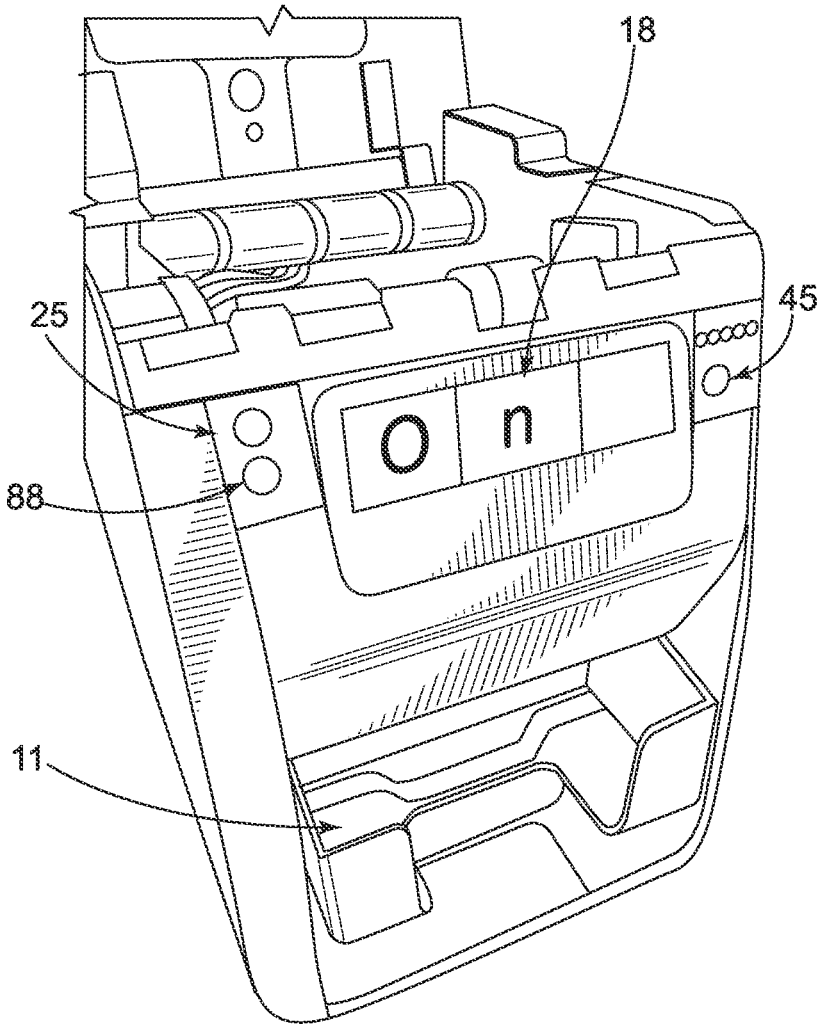
FIG. 11A shows a front view of an example napkin dispenser with a cover open, wherein a user interface indicates that the napkin dispenser has a low product indication system enabled, in accordance with example embodiments described herein.
Figure 11B:
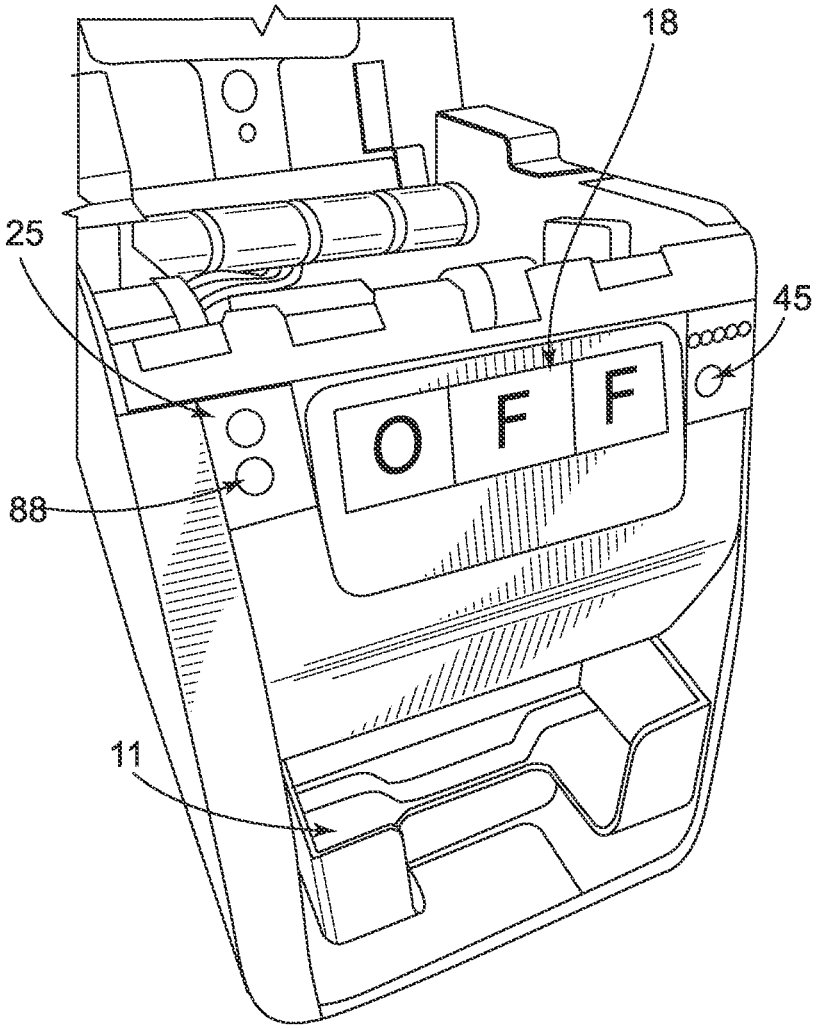
FIG. 11B shows a front view of an example napkin dispenser with a cover open, wherein a user interface indicates that the napkin dispenser has a low product indication system disabled, in accordance with example embodiments described herein.

FIGS. 11A-11B provide an example process for disabling the product level indication system. As shown in FIG. 11A, the user interface 18 indicates that the product level indication system is "On". To disable the product level indication system, a maintainer may press and hold one or more buttons for a predetermined amount of time, such as the calibration button 45 and the reverse button 88. In response, the product level indication system will become disabled and various indications of such can be provided, such as one or more LEDs in the dispensing area 11 may light up red and/or the user interface may display "OFF" (shown in FIG. 11B). However, if the process is repeated (e.g., the user presses and holds the one or more buttons (either the same buttons or different buttons)), the product level indication system will become enabled again and various indications of such can be provided, such as one or more LEDs in the dispensing area 11 may light up white and/or the user interface may display "On" (shown in FIG. 11A). The above described process is provided as an example, and some embodiments of the present invention contemplate other like processes.

Example System Architecture

A schematic representation of components of an example sheet product (e.g., napkin) dispenser 100 according to various embodiments described herein is shown in FIG. 12. It should be appreciated that the illustration in FIG. 12 is for purposes of description and that the relative size and placement of the respective components may differ. In this regard, the napkin dispenser 100 may take many different sizes, shapes, and configurations and may use many different types of components. Moreover, the components described in the examples herein may be interchangeable such that the napkin dispenser 100 is not limited to the given components or configurations of any one example. Rather, any of the components described herein and the like may be used together in any combination or orientation. Additional information regarding example napkin dispensers, including components and functionality thereof, can be found in U.S. Publication No. 2012/0138625, U.S. Publication No. 2015/0102048, and U.S. Pat. No. 9,604,811, each of which is assigned to the owner of the present invention and incorporated by reference in its entirety.

Generally described, the example napkin dispenser 100 may use one or more continuous rolls 110 of a sheet product 120. Any number of the rolls 110 may be used in the napkin dispenser 100. The sheet product 120 may include any type of natural and/or synthetic cloth or paper sheets including woven and non-woven articles. The sheet product 120 may or may not include perforations at given intervals. The leading end of the sheet product 120 on each roll 110 may be considered a tail 125. The napkin dispenser 100 separates and folds the sheet product 120 to produce a number of napkins 130 with a fold 135 therein. Depending on the configuration of the napkin dispenser (e.g., the type of sheet product including possible pre-folds, the various loading, dispensing, and/or folding mechanisms, etc.), the fold 135 may be a hard fold with a crease therein or more of a "U" or a "C"-shaped configuration. Moreover, multiple folds 135 also may be created, i.e., a "Z"-shaped fold or a dinner napkin fold also may be created herein.

The napkin dispenser 100 may include a number of stations so as to produce the napkins 130 from the sheet product 120 on the roll 110.

The napkin dispenser may include a loading station 140. The loading station 140 accepts the roll 110 of the sheet product 120 therein. The loading station 140 may include a loading mechanism 145 and a transfer mechanism 150. In some embodiments, the loading mechanism 145 may include a roll holder that is configured to receive and hold a product roll. In some embodiments, the loading station may include one or more rollers configured to pull and or transfer the sheet product 120. In some embodiments, the roll holder(s) may be configured to receive and hold any type of sheet product, such as core sheet product or coreless sheet product.

The napkin dispenser 100 also may include a folding station 160. The folding station 160 may perform a number of functions. The folding station 160 thus may include a folding mechanism 170 and a cutting mechanism 180. The folding mechanism 170 also may provide napkin separation, either with or without the cutting mechanism 180, such as a speed mechanism 185.

The napkin dispenser 100 also may include a presentation station 190. The presentation station 190 provides the napkins 130 to an end user.

In some embodiments, one or more of the described stations may form one or more dispensing mechanisms of the napkin dispenser. For example, in some embodiments, the dispensing mechanism may be considered to include at least some components of the loading station 140, folding station 160, and presentation station 190.

The napkin dispenser 100 also may include a user interface 200. The user interface 200 may allow the end user to select the number of napkins 130 and the like as well as allowing the end user to initiate a dispense. The user interface 200 may also be configured to provide information and/or indications to a user (e.g., related to calibration processes). In some embodiments, the user interface 200 may comprise one or more light emitting diodes (LEDs) to indicate such information (e.g., low battery, dispensing is occurring, low product level, transfer complete, etc.). In some embodiments, the user interface 200 may include a screen to display such information. In some embodiments, the user interface 200 may include an interface on the exterior of the napkin dispenser 100 such as for an end consumer. Additionally or alternatively, the user interface 200 (including a second user interface) may be configured to provide information or indications to a maintainer (e.g., maintenance personnel), such as internally of the cover of the napkin dispenser 100.

In some embodiments, the user interface 200 may be configured to receive user input such as through a keypad, touchscreen, buttons, or other input device. The user interface 200 may be in communication with the controller 215 such that the controller 215 can operate the user interface 200 and/or receive instructions or information from the user interface 200.

The napkin dispenser 100 may include one or more controllers 215. As will be described in more detail herein, the controller 215 provides logic and control functionality used during operation of the napkin dispenser 100. Alternatively, the functionality of the controller 215 may be distributed to several controllers that each provides more limited functionality to discrete portions of the operation of napkin dispenser 100.

The controller 215 is a suitable electronic device capable of executing dispenser functionality via hardware and/or software control, with the preferred embodiment accepting data and instructions, executing the instructions to process the data, and presenting the results. Controller 215 may accept instructions through the user interface 200, or through other means such as but not limited to an activation sensor, other sensors, voice activation means, manually-operable selection and control means, radiated wavelength and electronic or electrical transfer. Therefore, the controller 215 can be, but is not limited to, a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The controller 215 may be operably coupled with one or more components of the napkin dispenser 100. Such operable coupling may include, but is not limited to, solid-core wiring, twisted pair wiring, coaxial cable, fiber optic cable, mechanical, wireless, radio, and infrared. Controller 215 may be configured to provide one or more operating signals to these components and to receive data from these components. Such communication can occur using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The controller 215 may include one or more processors coupled to a memory device 112. Controller 215 may optionally be connected to one or more input/output (I/O) controllers or data interface devices (not shown). The memory 112 may be any form of memory such as an EPROM (Erasable Programmable Read Only Memory) chip, a flash memory chip, a disk drive, or the like. As such, the memory 112 may store various data, protocols, instructions, computer program code, operational parameters, etc. In this regard, controller 215 may include operation control methods embodied in application code. These methods are embodied in computer instructions written to be executed by one or more processors, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 215 may be configured to execute computer program code instructions to perform aspects of various embodiments of the present invention described herein. For example, the controller 215 may be configured to perform a calibration routine—such as described in various example embodiments herein.

The napkin dispenser 100 may include one or more product sensor(s) 205 (e.g., product level sensor(s)). In some embodiments, the product data may correspond to an amount of product remaining for a product roll (e.g., a remaining size of the product roll, an amount of the product roll remaining, etc.). The product sensor 205 may be in communication with the controller 215 such that the controller 215 may receive the product data and perform one or more determinations regarding the product data, such as described in various embodiments herein.

The napkin dispenser 100 may include a communication interface 113 that may be configured to enable connection to external systems (e.g., an external network 102). In this manner, the controller 215 may retrieve data and/or instructions from or transmit data and/or instructions to a remote, external server via the external network 102 in addition to or as an alternative to the memory 112.

In an example embodiment, the electrical energy (e.g., power 116) for operating the napkin dispenser 100 may be provided by a battery, which may be comprised of one or more batteries arranged in series or in parallel to provide the desired energy. For example, the battery may comprise four 1.5-volt "D" cell batteries. Additionally or alternatively, the power 116 may be supplied by an external power source, such as an alternating current ("AC") power source or a solar power source, or any other alternative power source as may be appropriate for an application. The AC power source may be any conventional power source, such as a 120V, 60 Hz wall outlets for example.

The napkin dispenser 100 may also include other sensor (s)/system(s) 115, such as any other type of sensors or systems that are usable in various embodiments of the present invention. Some example additional sensors or systems include a position sensor, a time sensor, a cover opening or closing sensor, activation sensor, among many others.

The described stations and other components of the napkin dispenser 100 may be enclosed in whole or in part in an outer shell (e.g., housing) 210. The outer shell 210 may be made out of any type of substantially rigid material. The outer shell 210 may have one or more loading doors (e.g., covers) 220 thereon. The napkin dispenser 100 also may be in communication with a cash register 225 or other type of ordering or input device. Other components and other mechanisms also may be used herein in many different configurations.

As indicated herein, some embodiments of the present invention may be utilized with other types of sheet product dispensers. For example, certain described embodiments herein may be utilized with tissue product dispensers. In such example embodiments, the tissue product dispenser may have components (e.g., motor, user interface, sensors, etc.) that are utilized with various embodiments of the present invention described herein. Additional information regarding example tissue product dispensers, including components and functionality thereof, can be found in U.S. Pat. Nos. 8,162,252 and 7,861,964, both of which are assigned to the owner of the present invention and incorporated by reference in their entireties. Similarly, certain described embodiments herein may be utilized with example automatic paper towel dispensers. In such example embodiments, the example automatic paper towel dispenser may have components (e.g., motor, user interface, sensors, etc.) that are utilized with various embodiments of the present invention described herein. Additional information regarding example automatic paper towel dispensers, including components and functionality thereof, can be found in U.S. Pat. No. 7,182,288, which is assigned to the owner of the present invention and incorporated by reference in its entirety. As another example, certain described embodiments herein may be utilized with mechanical sheet product dispensers. In such example embodiments, the mechanical sheet product dispenser may have components (e.g., user interface, sensors, etc.) that are utilized with various embodiments of the present invention described herein. Additional information regarding non-automated (mechanical) product dispensers, including components and functionality thereof, can be found in U.S. Pat. Nos. 7,270,292 and 5,441,189, both of which are assigned to the owner of the present invention and incorporated by reference in their entireties.

Also as indicated herein, some embodiments of the present invention may be utilized with other types of product dispensers. For example, certain described embodiments herein may be utilized with cutlery product dispensers. In such example embodiments, the cutlery dispenser may have components (e.g., motor, user interface, sensors, etc.) that are utilized with various embodiments of the present invention described herein. In such a regard, the described product level sensors may be configured to interact with the cutlery products that are to be dispensed in order to determine the amount of cutlery products remaining. One of ordinary skill in the art (in view of this disclosure) may appreciate that a different calibration system and/or method may be used to calibrate non-rolled products, such as cutlery. For example, one or more calibration blocks or cutlery substitutes could be used in place of the described calibration rolls. Additional information regarding example cutlery product dispensers, including components and functionality thereof, can be found in U.S. Pat. No. 9,237,815, which is assigned to the owner of the present invention and incorporated by reference in its entirety. As another example, certain described embodiments herein may be utilized with soap product dispensers. In such example embodiments, the soap dispenser may have components (e.g., pump, user interface, sensors, etc.) that are utilized with various embodiments of the present invention described herein. In such a regard, the described product level sensors may be configured to interact with the soap product that is to be dispensed in order to determine the amount of soap product remaining. One of ordinary skill in the art (in view of this disclosure) may appreciate that a different calibration system and/or method may be used to calibrate non-rolled products, such as soap. For example, one or more calibration packages or soap package substitutes could be used in place of the described calibration rolls. Additional information regarding example soap product dispensers, including components and functionality thereof, can be found in U.S. Pat. No. 8,746,510 and U.S. patent application Ser. No. 15/338,902, both of which are assigned to the owner of the present invention and incorporated by reference in their entireties.

Example Flowchart(s)

Embodiments of the present invention provide methods, apparatuses and computer program products for controlling and operating sheet product dispensers according to various embodiments described herein. Various examples of the operations performed in accordance with embodiments of the present invention will now be provided with reference to FIGS. 13-16.

Figure 13:
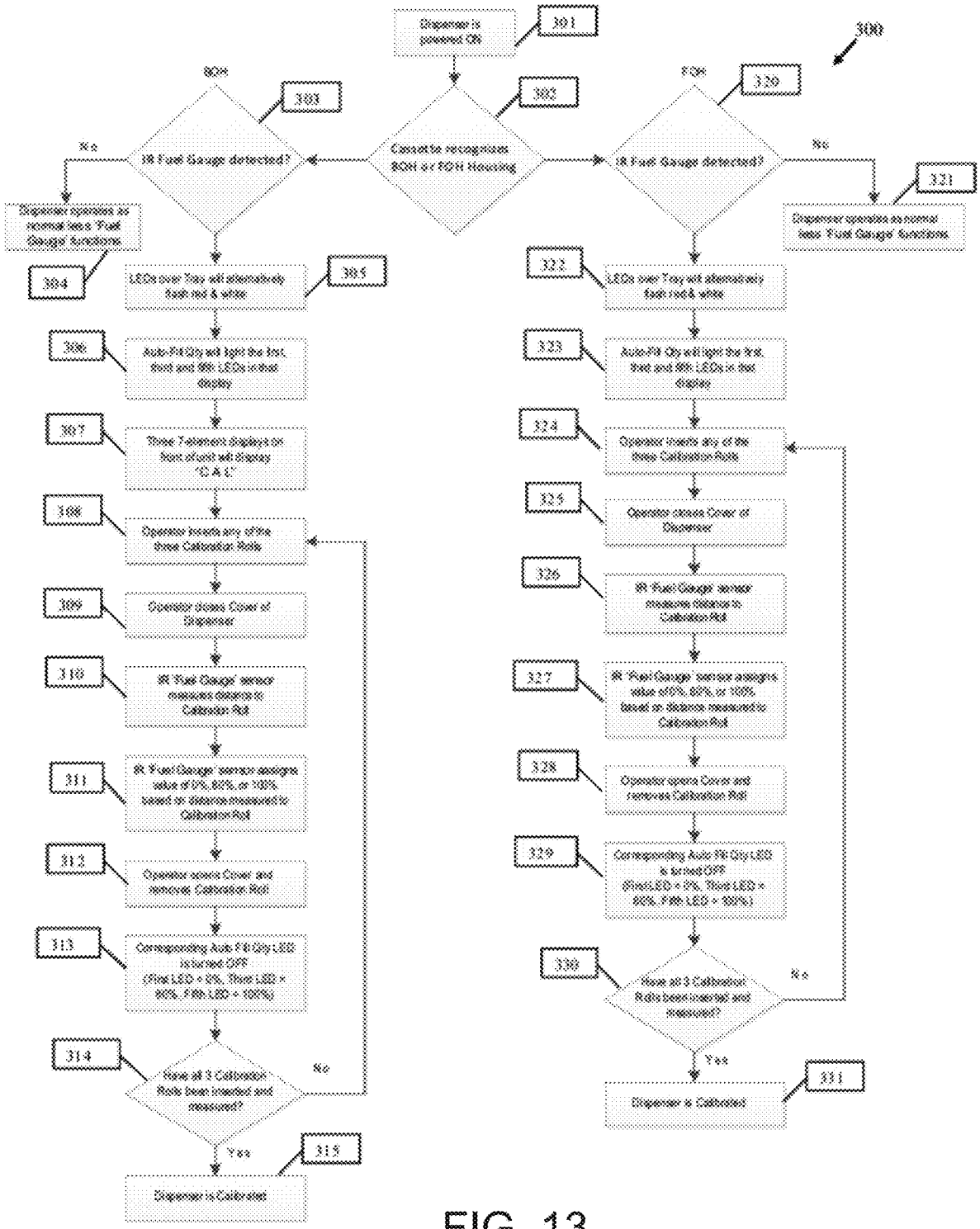
FIG. 13 illustrates a flowchart of an example method for calibrating a product level sensor for a sheet product dispenser, in accordance with some embodiments discussed herein.

FIG. 13 illustrates a flowchart according to an example method for calibrating a product depletion curve for accurately determining a product level remaining using a product level sensor for a sheet product dispenser according to an example embodiment. The operations illustrated in and described with respect to FIG. 13 may, for example, be performed by, with the assistance of, and/or under the control of one or more of the controller 215, memory 112, communication interface 113, user interface 200, product sensor 205, dispensing mechanism 140/160/190, power 116, activation sensor, and/or other sensor(s)/system(s) 115 of the sheet product dispenser 100.

The method 300 may include receiving an indication that the dispenser is powered on at operation 301. Operation 302 comprises determining whether the cassette recognizes whether the dispenser is a BOH dispenser or an FOH dispenser. If the dispenser is a BOH dispenser, then the method follows to operation 303. If the dispenser is an FOH dispenser, then the method follows to operation 320.

For a BOH dispenser, at operation 303, the method determines whether a fuel gauge (e.g., product level sensor) is detected. If no fuel gauge is detected, then, at operation 304, the dispenser operates as normal without any "Fuel Gauge" functions. If there is a fuel gauge detected, then, at operation 305, the LEDs over the tray will alternatively flash red and white. At operation 306, the first, third, and fifth LEDs will illuminate on the user interface (e.g., corresponding to the calibration rolls). At operation 307, the three 7-element displays of the user interface 18 will display "CAL".

At operation 308, the operator inserts one of the calibration rolls. At operation 309, the operator closes the cover of the dispenser. At operation 310, the product level sensor operates to emit a signal and measure the brightness value, which corresponds to the distance to the surface of the inserted calibration roll. At operation 311, the controller/product level sensor assigns the measured brightness value/corresponding distance to a calibration value of 0%, 60%, or 100%. At operation 312, the operator opens the cover and removes the inserted calibration roll. At operation 313, the LED corresponding to that calibration roll is turned off (unilluminated). At operation 314, the controller determines whether all three calibration rolls have been inserted and measured. If not, the method returns to operation 308 for another calibration roll. If all three calibration rolls have been inserted and measured, then the method proceeds to operation 315 and the dispenser is calibrated.

For a FOH dispenser, at operation 320, the method determines whether a fuel gauge (e.g., product level sensor) is detected. If no fuel gauge is detected, then, at operation 321, the dispenser operates as normal without any "Fuel Gauge" functions. If there is a fuel gauge detected, then, at operation 322, the LEDs over the tray will alternatively flash red and white. At operation 323, the first, third, and fifth LEDs will illuminate on the user interface (e.g., corresponding to the calibration rolls).

At operation 324, the operator inserts one of the calibration rolls. At operation 325, the operator closes the cover of the dispenser. At operation 326, the product level sensor operates to emit a signal and measure the brightness value, which corresponds to the distance to the surface of the inserted calibration roll. At operation 327, the controller/product level sensor assigns the measured brightness value/corresponding distance to a calibration value of 0%, 60%, or 100%. At operation 328, the operator opens the cover and removes the inserted calibration roll. At operation 329, the LED corresponding to that calibration roll is turned off (unilluminated). At operation 330, the controller determines whether all three calibration rolls have been inserted and measured. If not, the method returns to operation 324 for another calibration roll. If all three calibration rolls have been inserted and measured, then the method proceeds to operation 331 and the dispenser is calibrated.

Figure 14:
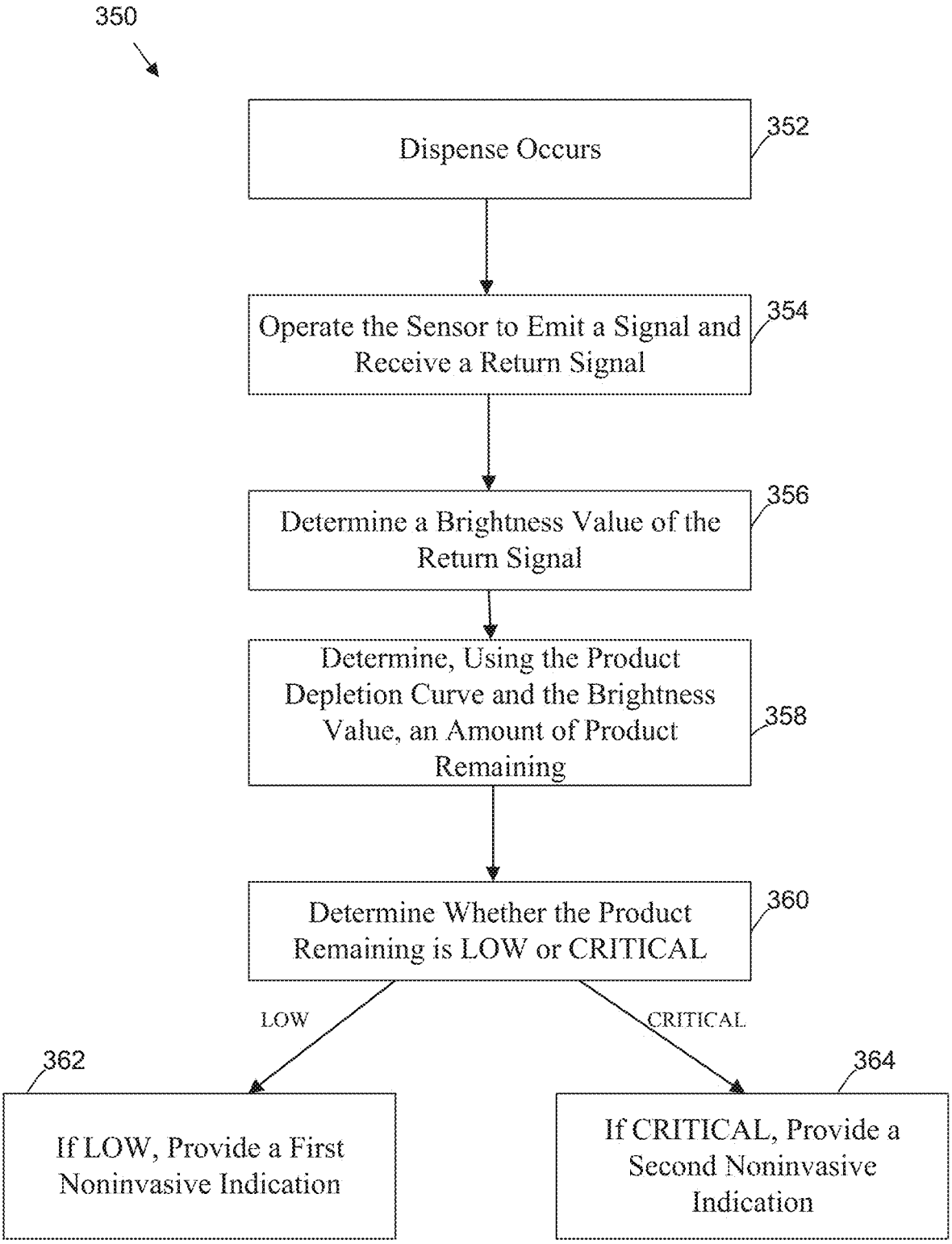
FIG. 14 illustrates a flowchart of an example method for indicating a low or critical product level remaining, in accordance with some embodiments discussed herein.

FIG. 14 illustrates a flowchart according to an example method for providing a product level indication for a sheet product dispenser according to an example embodiment. The operations illustrated in and described with respect to FIG. 14 may, for example, be performed by, with the assistance of, and/or under the control of one or more of the controller 215, memory 112, communication interface 113, user interface 200, product sensor 205, dispensing mechanism 140/160/190, power 116, activation sensor, and/or other sensor(s)/system(s) 115 of the sheet product dispenser 100.

The method 350 may include operating the dispenser to perform a dispense at operation 352. At operation 354, the product level sensor may operate to emit a signal and receive a return signal. At operation 356, the controller/product level sensor may determine a brightness value of the return signal. At operation 358, the controller/product level sensor may determine, using the product depletion curve and the measured brightness value, an amount of product remaining. At operation 360, the controller/product level sensor may determine whether the amount of product remaining is within a LOW fuel range or a CRITICAL fuel range. If in a LOW fuel range, a first noninvasive indication may be provided at operation 362. If in a CRITICAL fuel range, a second noninvasive indication may be provided at operation 364.

Figure 15:
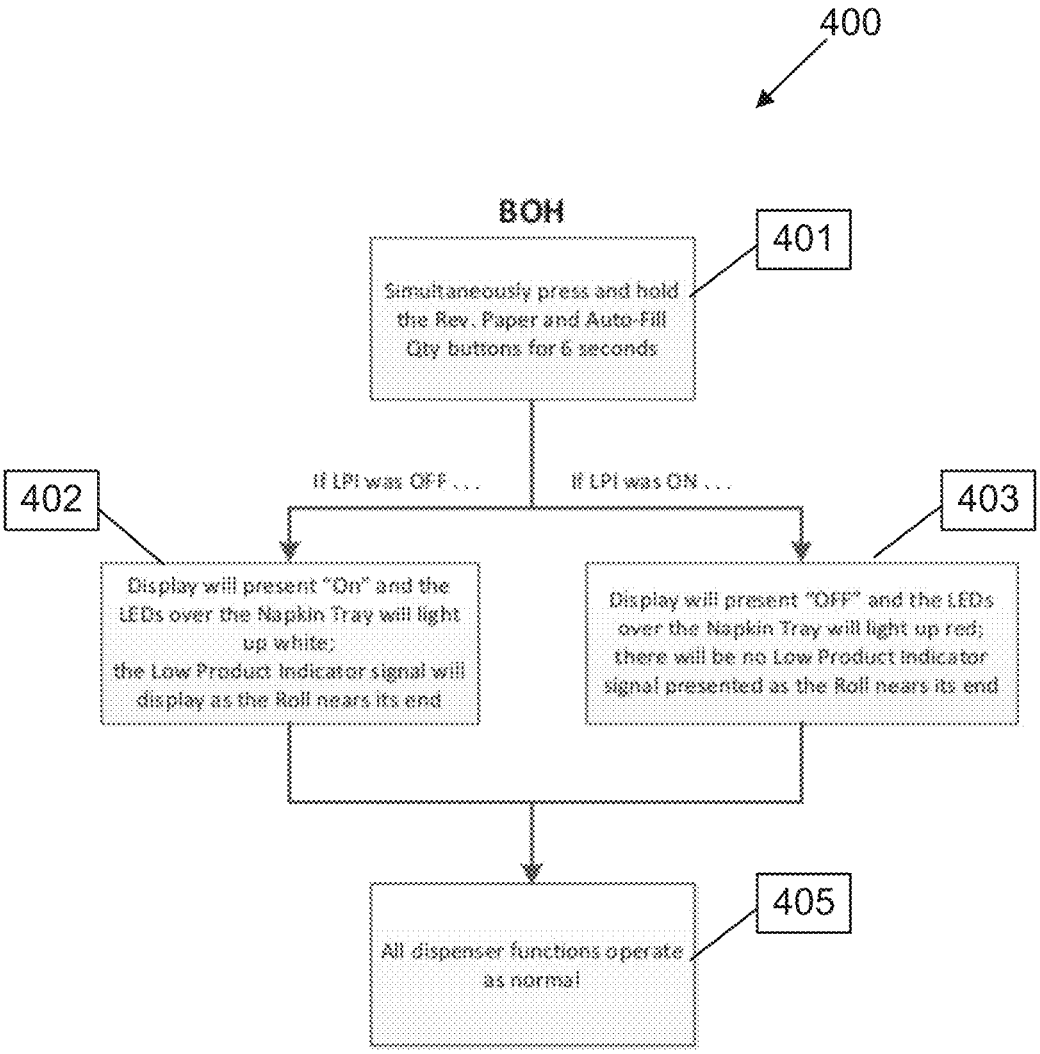
FIGS. 15-16 illustrate flowcharts of example methods for enabling or disabling a low product level indication system, in accordance with some embodiments discussed herein.

FIG. 15 illustrates a flowchart according to an example method for enabling or disabling a product level indication system for a BOH sheet product dispenser according to an example embodiment. The operations illustrated in and described with respect to FIG. 15 may, for example, be performed by, with the assistance of, and/or under the control of one or more of the controller 215, memory 112, communication interface 113, user interface 200, product sensor 205, dispensing mechanism 140/160/190, power 116, activation sensor, and/or other sensor(s)/system(s) 115 of the sheet product dispenser 100.

The method 400 may include receiving a user input that includes a simultaneous press and hold of a reverse feed button and a calibration button for 6 seconds at operation 401. If the product level indication is currently OFF, then at operation 402, the display will present "On" and the LEDs over the tray will light up white, as well as the Low Product Indicator signal will display as the amount of product remaining reaches the appropriate threshold(s). If the product level indication is currently ON, then at operation 403, the display will present "OFF" and the LEDs over the tray will light up red, as well as the Low Product Indicator signal will not display as the amount of product remaining reaches the appropriate threshold(s). Finally, all dispenser functions will operate as normal at operation 405.

Figure 16:
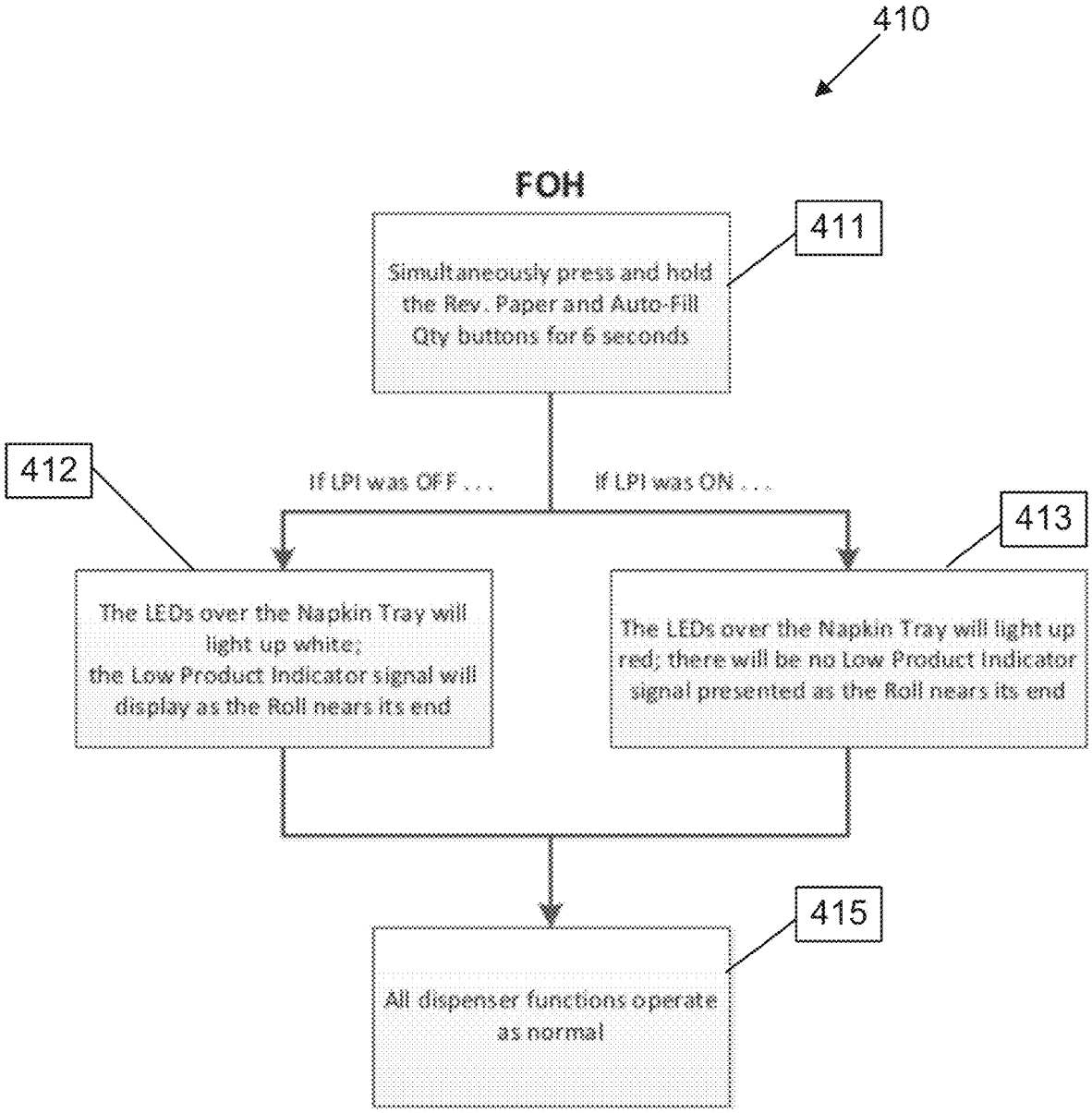

FIG. 16 illustrates a flowchart according to an example method for enabling or disabling a product level indication system for a FOH sheet product dispenser according to an example embodiment. The operations illustrated in and described with respect to FIG. 16 may, for example, be performed by, with the assistance of, and/or under the control of one or more of the controller 215, memory 112, communication interface 113, user interface 200, product sensor 205, dispensing mechanism 140/160/190, power 116, activation sensor, and/or other sensor(s)/system(s) 115 of the sheet product dispenser 100.

The method 410 may include receiving a user input that includes a simultaneous press and hold of a reverse feed button and a calibration button for 6 seconds at operation 411. If the product level indication is currently OFF, then at operation 412, the LEDs over the tray will light up white and the Low Product Indicator signal will display as the amount of product remaining reaches the appropriate threshold(s). If the product level indication is currently ON, then at operation 413, the LEDs over the tray will light up red and the Low Product Indicator signal will not display as the amount of product remaining reaches the appropriate threshold(s). Finally, all dispenser functions will operate as normal at operation 415.

FIGS. 13-16 illustrate flowcharts of a system, method, and computer program product according to various example embodiments described herein. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 112 and executed by, for example, the controller 215. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device (for example, sheet product dispenser 100) to cause a series of operations to be performed on the computer or other programmable apparatus to produce a computer-implemented process such that the instructions which execute on the computer or other programmable apparatus implement the functions specified in the flowchart block(s).

Associated systems and methods for manufacturing example sheet product dispensers described herein are also contemplated by some embodiments of the present invention.

Conclusion

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A sheet product dispenser comprising:

a housing;

a roll holder configured to receive a product roll;

a dispensing mechanism configured to receive sheet product from the product roll and dispense a portion of the sheet product from the product roll;

a sensor configured to emit a signal toward the product roll and receive a return signal, wherein the return signal reflected off a surface of the product roll;

a user interface; and a controller, wherein, after a dispense occurs, the controller is configured to:

operate the sensor to emit the signal and receive the return signal;

determine a brightness value of the return signal;

determine, based on a product depletion curve and the determined brightness value of the product level return signal, an amount of product remaining on the product roll;

determine if the amount of product remaining is within either a first reduced fuel range or a second reduced fuel range, wherein the first reduced fuel range comprises a first range of amount of product remaining values, wherein the second reduced fuel range comprises a second range of amount of product remaining values, wherein each of the amount of product remaining values in the first reduced fuel range is greater than each of the amount of product remaining values in the second reduced fuel range, wherein each of the amount of product remaining values in the first reduced fuel range is less than 50% product remaining; and cause, in an instance in which the amount of product remaining is within the first reduced fuel range, the user interface to provide a first indication, or cause, in an instance in which the amount of product remaining is within the second reduced fuel range, the user interface to provide a second indication, wherein the second indication is more invasive than the first indication.

2. The sheet product dispenser of claim 1, wherein the first indication comprises a first number of pulses of one or more LEDs, wherein the second indication comprises a second number of pulses of the one or more LEDs, wherein the second number of pulses of the one or more LEDs is greater than the first number of pulses.

3. The sheet product dispenser of claim 1, wherein the first reduced fuel range is less than 30% product remaining and greater than 10% product remaining, and wherein the second reduced fuel range is equal to or less than 10% product remaining.

4. The sheet product dispenser of claim 1, wherein the controller is only configured to cause the user interface to provide either the first indication or the second indication after a dispense occurs such that the first indication or the second indication is not constantly occurring.

5. The sheet product dispenser of claim 1, wherein the controller is configured to disable the first indication or the second indication in response to a user input indicating a desire to not provide a low product remaining indication.

6. The sheet product dispenser of claim 1, wherein the sheet product dispenser is a napkin dispenser configured to dispense a number of folded napkins.

* * * * *